US007296613B2

(12) United States Patent
Anderson et al.

(10) Patent No.: US 7,296,613 B2
(45) Date of Patent: Nov. 20, 2007

(54) MOLD TABLE SENSING AND AUTOMATION SYSTEM

(75) Inventors: Michael K. Anderson, Otis Orchards, WA (US); Robert L. Fletcher, Newman Lake, WA (US)

(73) Assignee: Wagstaff, Inc., Spokane, WA (US)

( * ) Notice: Subject to any disclaimer, the term of this patent is extended or adjusted under 35 U.S.C. 154(b) by 39 days.

(21) Appl. No.: 10/461,075

(22) Filed: Jun. 13, 2003

(65) Prior Publication Data

US 2004/0250982 A1 Dec. 16, 2004

(51) Int. Cl.
*B22D 11/16* (2006.01)

(52) U.S. Cl. ..... 164/452; 164/155.1

(58) Field of Classification Search ..... 164/151.5, 164/151.4, 155.6, 452, 155.1, 453, 455
See application file for complete search history.

(56) References Cited

U.S. PATENT DOCUMENTS 3,834,445 A * 9/1974 Raschke ..... 164/150.1
4,809,766 A * 3/1989 Greene et al. ..... 164/151
4,982,779 A 1/1991 Nagai et al. ..... 164/152
5,409,054 A 4/1995 Moriceau ..... 164/453
5,674,426 A 10/1997 Schmid et al. ..... 222/602
5,700,422 A * 12/1997 Usui et al. ..... 266/94
6,279,645 B1 * 8/2001 McGlade et al. ..... 164/151.5
6,446,704 B1 9/2002 Collins ..... 164/488

FOREIGN PATENT DOCUMENTS

CA 02233203 10/1996
WO PCT AU 96 00678 10/1996

* cited by examiner

*Primary Examiner*—Len Tran
(74) *Attorney, Agent, or Firm*—Wells St. John P.S.

(57) ABSTRACT

A molten metal sensing and automation system for use with or in a metal casting mold. Aspects of the invention include a molten metal automation system which may include a bleedout detection system which provides an automated response, and an automated system for the preparation of the starting blocks for casting.

7 Claims, 17 Drawing Sheets

300
329
284
HMI INTERFACE
328
325
ETHERNET
326
327
OFFICE SCADA
324
PLC CONTROLLER
319
321
REMOTE I/O RACK
322
-24 VDC
+24 VDC
320
318
317
316
315
314
313
312
311
310
309
308
307
306
305
304
303
302
301

MOLD TABLE SENSING AND AUTOMATION SYSTEM

CROSS REFERENCE TO RELATED APPLICATION

This application does not claim priority from any other application.

TECHNICAL FIELD

This invention pertains to a molten metal mold casting system for use in the casting of ferrous and non-ferrous molds. More particularly, this invention provides a mold table sensing and automation system which provides multiple embodiments and aspects relating to bleedout detection, and the automation of other tasks utilizing a controlled arm or table mechanism.

BACKGROUND OF THE INVENTION

Metal ingots, billets and other castparts are typically formed by a casting process which utilizes a vertically oriented mold situated above a large casting pit beneath the floor level of the metal casting facility, although this invention may also be utilized in horizontal molds. The lower component of the vertical casting mold is a starting block. When the casting process begins, the starting blocks are in their upward-most position and in the molds. As molten metal is poured into the mold bore or cavity and cooled (typically by water), the starting block is slowly lowered at a predetermined rate by a hydraulic cylinder or other device. As the starting block is lowered, solidified metal or aluminum emerges from the bottom of the mold and ingots, rounds or billets of various geometries are formed, which may also be referred to herein as castparts.

While the invention applies to the casting of metals in general, including without limitation aluminum, brass, lead, zinc, magnesium, copper, steel, etc., the examples given and preferred embodiment disclosed may be directed to aluminum, and therefore the term aluminum may be used throughout for consistency even though the invention applies more generally to metals.

While there are numerous ways to achieve and configure a vertical casting arrangement, FIG. 1 illustrates one example. In FIG. 1, the vertical casting of aluminum generally occurs beneath the elevation level of the factory floor in a casting pit. Directly beneath the casting pit floor 101*a* is a caisson 103, in which the hydraulic cylinder barrel 102 for the hydraulic cylinder is placed.

As shown in FIG. 1, the components of the lower portion of a typical vertical aluminum casting apparatus, shown within a casting pit 101 and a caisson 103, are a hydraulic cylinder barrel 102, a ram 106, a mounting base housing 105, a platen 107 and a starting block base 108 (also referred to as a starting head or bottom block), all shown at elevations below the casting facility floor 104.

The mounting base housing 105 is mounted to the floor 101*a* of the casting pit 101, below which is the caisson 103. The caisson 103 is defined by its side walls 103*b* and its floor 103*a*.

A typical mold table assembly 110 is also shown in FIG. 1, which can be tilted as shown by hydraulic cylinder 111 pushing mold table tilt arm 110*a* such that it pivots about point 112 and thereby raises and rotates the main casting frame assembly, as shown in FIG. 1. There are also mold table carriages which allow the mold table assemblies to be moved to and from the casting position above the casting pit.

FIG. 1 further shows the platen 107 and starting block base 108 partially descended into the casting pit 101 with castpart or billet 113 being partially formed. Castpart 113 is on the starting block base 108, which may include a starting head or bottom block, which usually (but not always) sits on the starting block base 108, all of which is known in the art and need not therefore be shown or described in greater detail. While the term starting block is used for item 108, it should be noted that the terms bottom block and starting head are also used in the industry to refer to item 108, bottom block is typically used when an ingot is being cast and starting head when a billet is being cast.

While the starting block base 108 in FIG. 1 only shows one starting block 108 and pedestal 115, there are typically several of each mounted on each starting block base, which simultaneously cast billets, special shapes or ingots as the starting block is lowered during the casting process, as shown in later Figures and as is known.

When hydraulic fluid is introduced into the hydraulic cylinder at sufficient pressure, the ram 106, and consequently the starting block 108, are raised to the desired elevation start level for the casting process, which is when the starting blocks are within the mold table assembly 110.

The lowering of the starting block 108 is accomplished by metering the hydraulic fluid from the cylinder at a predetermined rate, thereby lowering the ram 106 and consequently the starting block at a predetermined and controlled rate. The mold is controllably cooled during the process to assist in the solidification of the emerging ingots or billets, typically using water cooling means.

There are numerous mold and casting technologies that fit into mold tables, and no one in particular is required to practice the various embodiments of this invention, since they are known by those of ordinary skill in the art.

Mold tables come in all sizes and configurations because there are numerous and differently sized and configured casting pits over which mold tables are placed. The needs and requirements for a mold table to fit a particular application therefore depends on numerous factors, some of which include the dimensions of the casting pit, the location (s) of the sources of water and the practices of the entity operating the pit.

The upper side of the typical mold table operatively connects to, or interacts with, the metal distribution system. The typical mold table also operatively connects to the molds which it houses.

When metal is cast using a continuous cast vertical mold, the molten metal is cooled in the mold and continuously emerges from the lower end of the mold as the starting block base is lowered. The emerging billet, ingot or other configuration is intended to be sufficiently solidified such that it maintains its desired shape. There is typically an air gap between the emerging solidified metal and the permeable ring wall. Below that, there is also a mold air cavity between the emerging solidified metal and the lower portion of the mold and related equipment.

Since the casting process generally utilizes fluids, including lubricants, there is necessarily conduits and/or piping designed to deliver the fluid to the desired locations around the mold cavity. Although the term lubricant will be used throughout this specification, it is understood that this also means fluids of all types, whether a lubricant or not, and may also include release agents.

Working in and around a casting pit and molten metal can be potentially dangerous and it is desired to continually find ways to increase safety and minimize the danger or accident potential to which operators of the equipment are exposed.

In one aspect of the invention, it is an object to provide an automated system to perform tasks related to the casting process which may improve safety, through the use of an automated controlled mechanism which is referred to herein as a controlled arm, but which may include an articulated arm, a robotic arm, or an X-Y machine. While all of these may also be considered x-y machines or x-y devices, it will be appreciated by those of ordinary skill in the art that the machines described herein and referred to as x-y machines may also include motion in a third dimension (the z direction). Use of the term x-y device herein, for purposes of this invention, therefore includes the above devices and devices with movement in the third or z direction. The two and three dimensional tasks referred to herein may include the insertion of mold plugs in the mold cavities, the drying, cleaning and/or oiling of the starting heads prior to commencement of casting, the application of release agents, as well as others.

BRIEF DESCRIPTION OF THE DRAWINGS

Preferred embodiments of the invention are described below with reference to the following accompanying drawings.

FIG. 4 is an elevation view of a mold table with a controlled arm mounted thereon and providing a mold plug to a mold cavity;

FIG. 8 is a view of a plug and tool rack which may be used to hold plugs, dams, compressed air nozzle configurations and lubricant oil applicators, to name a few;

FIG. 9 is a schematic diagram of an embodiment of a control system configuration which may be utilized by this invention;

FIG. 10 is a schematic diagram of the operational connection of the bleedout detector to the +24 VDC via line and to the input output controller;

FIG. 12 is a schematic depiction of an embodiment of the invention wherein a compressed air nozzle is utilized to remove water and other undesired elements from the starting head, and showing an oil applicator applying oil to the starting head;

FIG. 13 is an elevation view of a mold table with a controlled arm mounted thereon and which is applying compressed air or oil to the starting head through a mold cavity;

FIG. 14 is an elevation view of a mold table with a controlled X-Y framework utilized in an aspect of the invention instead of the articulated arm, providing a mold plug to a mold cavity;

FIG. 16 is a perspective elevation view of one embodiment of this invention mounted on a mold table, with a casting perimeter; and FIG. 17 is a perspective view of one embodiment of the invention, wherein the controlled arm is inserting a mold plug through the refractory molten metal feed system and into a mold cavity.

DETAILED DESCRIPTION OF THE PREFERRED EMBODIMENTS

Many of the fastening, connection, manufacturing and other means and components utilized in this invention are widely known and used in the field of the invention described, and their exact nature or type is not necessary for an understanding and use of the invention by a person skilled in the art or science; therefore, they will not be discussed in significant detail. Furthermore, the various components shown or described herein for any specific application of this invention can be varied or altered as anticipated by this invention and the practice of a specific application or embodiment of any element may already be widely known or used in the art or by persons skilled in the art or science; therefore, each will not be discussed in significant detail.

The terms "a", "an", and "the" as used in the claims herein are used in conformance with long-standing claim drafting practice and not in a limiting way. Unless specifically set forth herein, the terms "a", "an", and "the" are not limited to one of such elements, but instead mean "at least one".

It is to be understood that this invention applies to and can be utilized in connection with various types of metal pour technologies and configurations. It is further to be understood that this invention may be used on horizontal or vertical casting devices.

The mold therefore must be able to receive molten metal from a source of molten metal, whatever the particular source type is. The mold cavities in the mold must therefore be oriented in fluid or molten metal receiving position relative to the source of molten metal.

It will also be appreciated by those of ordinary skill in the art that embodiments of this invention may and will be combined with new systems and/or retrofit to existing operating casting systems, all within the scope of this invention. Applicant hereby incorporates by reference, U.S. Pat. No. 6,446,704, as though fully set forth herein.

It will be appreciated by those of ordinary skill in the art that embodiments of this system may include either a controlled or robotic arm, or it may include an X-Y table, or a hybrid of both, all within the contemplation of embodiments of this invention.

Figure 1:
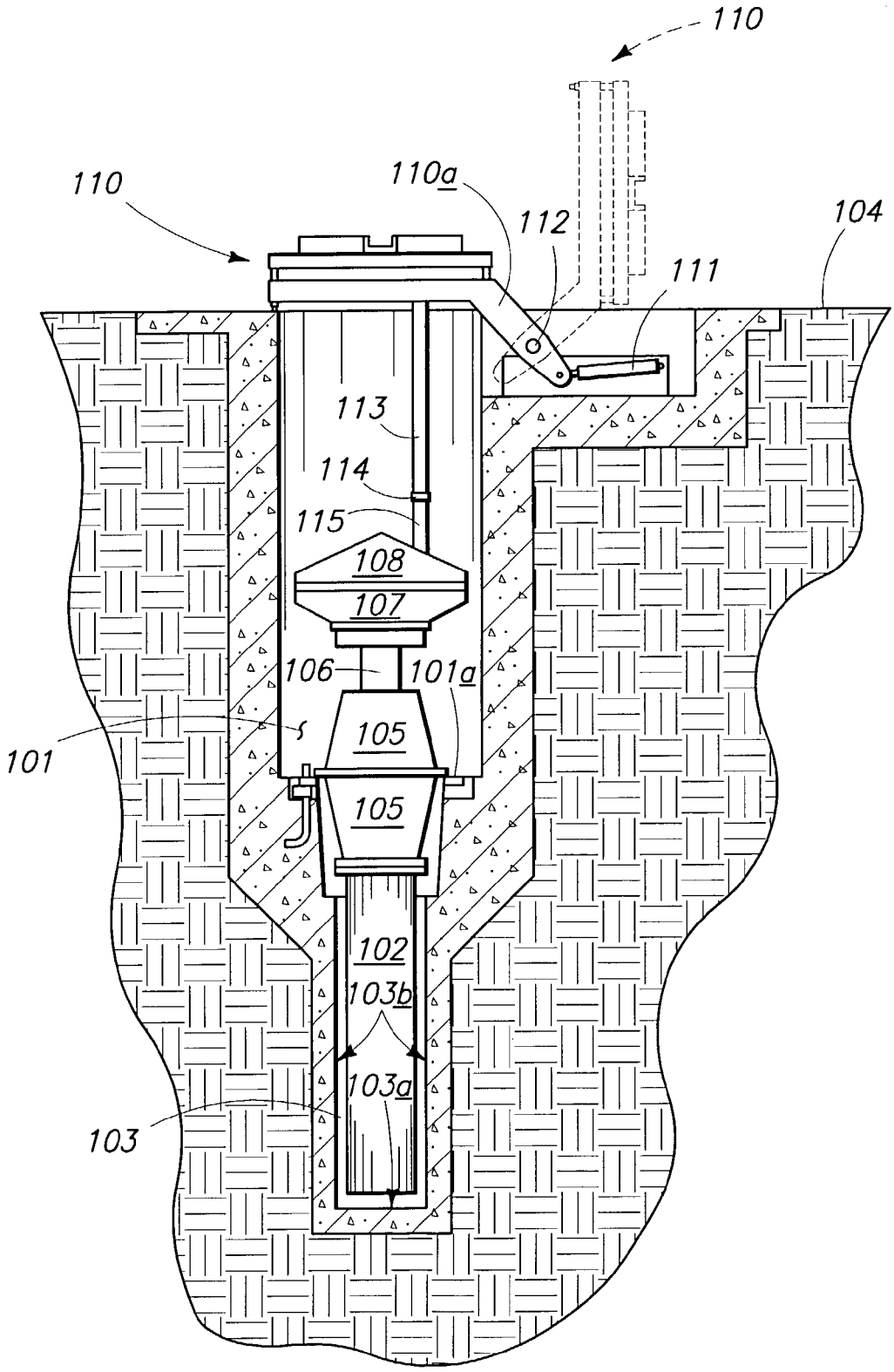
FIG. 1 is an elevation view of a typical vertical casting pit, caisson and metal casting apparatus.

FIG. 1 is an elevation view of a vertical casting pit, caisson and metal casting apparatus, and is described in more detail above.

Figure 2:
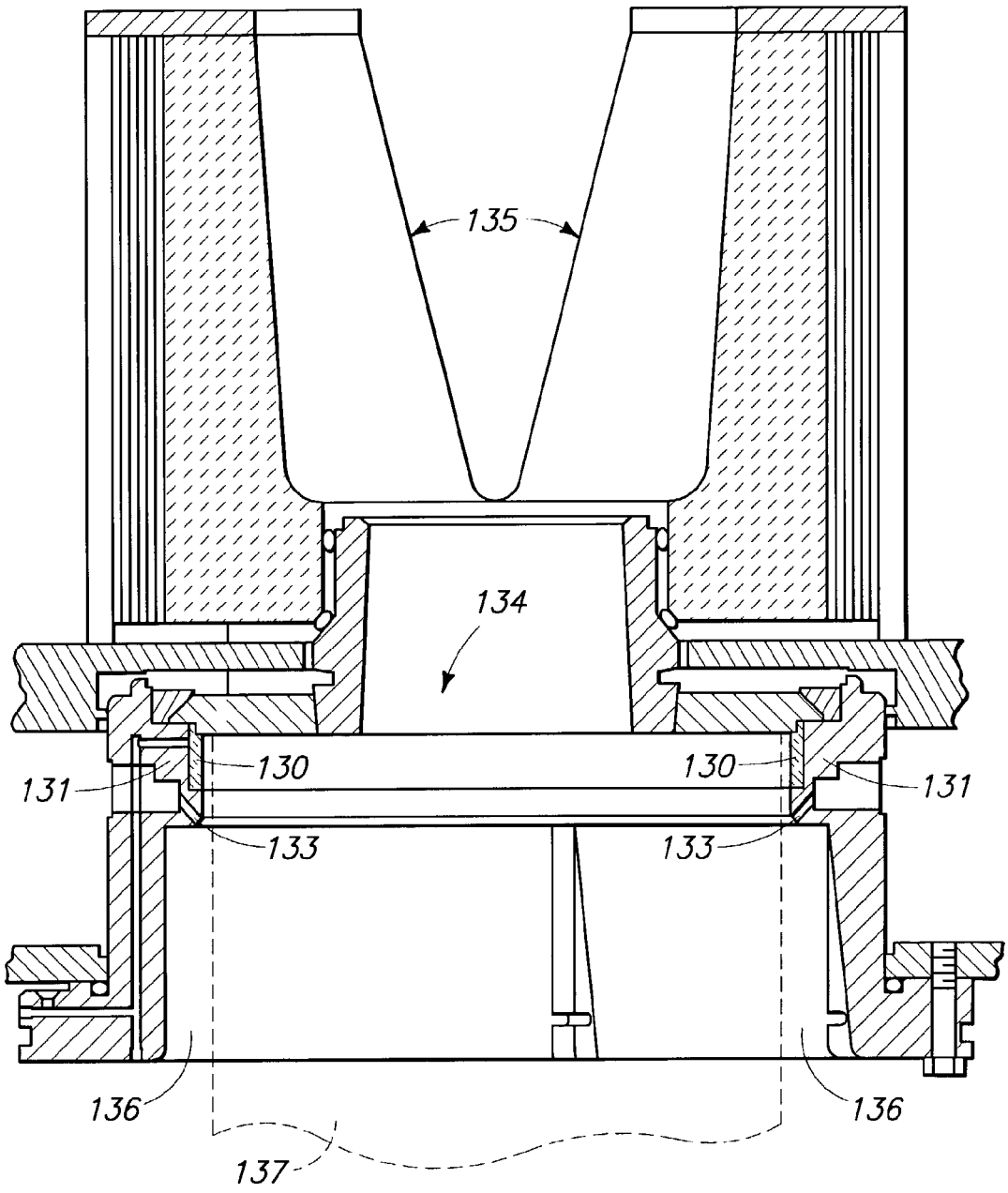
FIG. 2 is a perspective view of one of the numerous mold frameworks with which embodiments of this invention may be utilized.

FIG. 2 is a perspective view of one of the numerous mold frameworks with which embodiments of this invention may be utilized, illustrating refractory trough 135, mold inlet 134, mold outlet 136, permeable perimeter wall 130, typically a graphite ring, water inlet conduits 133 and mold framework 131. FIG. 2 further illustrates a round castpart 137 emerging from mold outlet 136.

Figure 3:
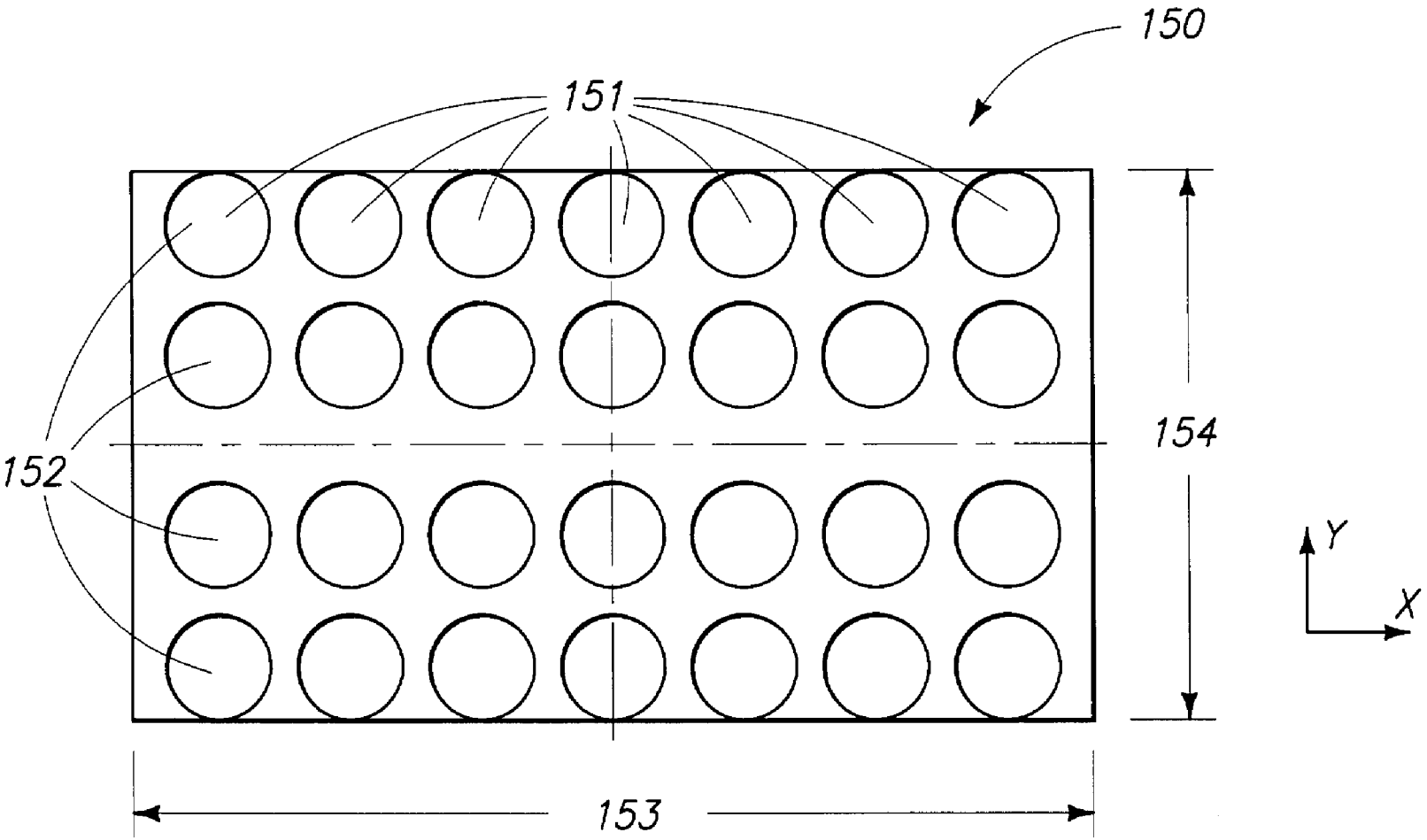
FIG. 3 is a schematic top view depiction of a mold table with four rows and seven columns of molten metal molds.

FIG. 3 is a schematic top view depiction of a mold table 150 with four rows 152 and seven columns 151 of molten metal molds, illustrating exemplary two dimensional X-Y coordinates. FIG. 3 shows mold table with x dimension 153 and y dimension 154.

FIG. 4 is an elevation view of a mold table 170 with a controlled arm 179 mounted thereon and providing a mold plug 185*a* to a mold cavity 178. FIG. 4 illustrates mold table framework 175, casting pit 171, and starting block base 169. The starting block base 169 moves vertically during casting as represented by arrow 174. This embodiment is shown with a molten metal pour system 172 generally comprised of refractory troughs such as trough 173. FIG. 4 also shows a first mold cavity 177 and third mold cavity 178, in addition to others not shown with item numbers.

In this embodiment a robotic, controlled or articulated arm 179 may be utilized, and it may be any one of a number of different configurations within the contemplation of this invention. FIG. 4 illustrates arm mount 180, with base 181 pivotally mounted to arm mount 180. A first end of first arm section 182 is pivotally attached to base 181, with a first end of second arm section 183 pivotally attached to a second end of first arm section 182, as shown.

The controlled arm 179 further includes coupler section 168 pivotally attached to a second end or section arm section 183, with attachment hands 184 (also referred to as grippers) for interacting with tools such as mold plugs, trough dams and air or oil nozzles, for example. The control arm 179 may further include a telescoping section 183*a* to allow the lengthening of the second arm section 183 for increased range.

FIG. 4 illustrates the controlled arm 179 gripping a mold plug 185 and inserting it in a first mold cavity (solid lines), and in a second mold cavity (as represented by the phantom lines). The control system provided herein may easily be programmed to respond to a bleedout condition for instance, to obtain a mold plug and place it in a position to block the flow of molten metal through the mold cavity where the bleedout occurred.

The controlled arm 179 may be any one of a number of available controlled arms, such as that marketed by Fanuc Robotics of America, Lake Forest, Ill., or Panasonic Robotics. The controlled arms are available with control systems which are generally known and usable by those of ordinary skill in the art.

It will also be appreciated by those of ordinary skill in the art that the articulated arm embodiment disclosed in this invention may be permanently or temporarily mounted or positioned on or near the mold table in question. In the temporary positioning embodiment, the control system may be programmed or configured to perform the same functions or tasks on more than one mold table, and the articulated or robotic arm may then be moved between mold tables in a facility. The one or more mold tables may be in different pits, or in the same pit. In another embodiment for instance, the controlled arm may be mounted adjacent one casting pit and more than one casting table may be utilized in the pit, with the controller for the controlled arm being programmed, configured or disposed, to perform its tasks on each of the desired mold tables.

Figure 5:
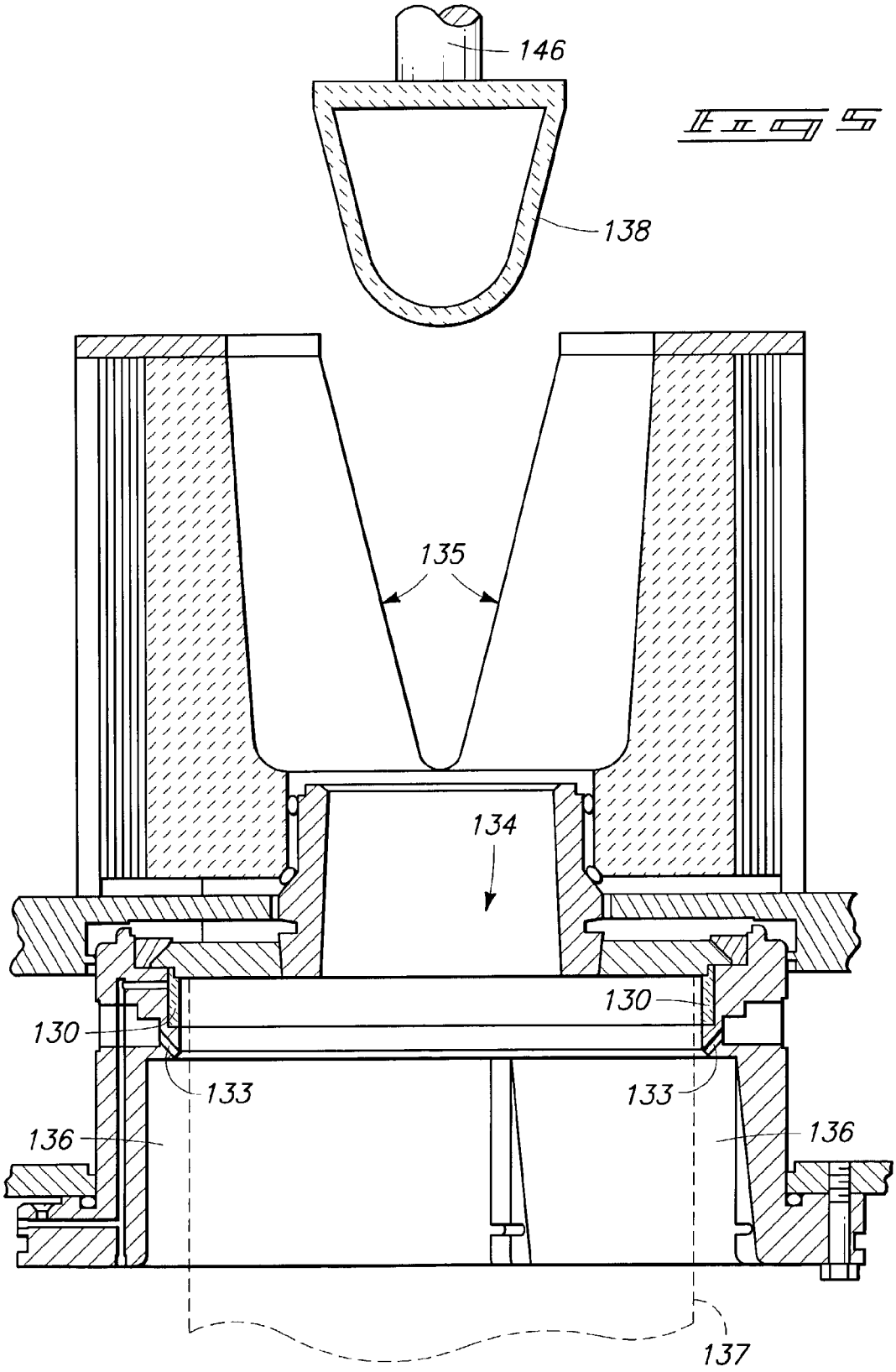
FIG. 5 is an elevation section view of one embodiment of a mold which may be utilized by this invention, wherein the metal flow stop device is a mold plug which is positioned above the mold inlet and could be lowered downwardly into the mold cavity to stop the flow of metal to the mold.

FIG. 5 is an elevation section view of one embodiment of a mold which may be utilized by this invention, wherein the metal flow stop device is a mold plug 138 with handle 146, which is positioned above the mold inlet and could be lowered downwardly into the mold cavity 134 to stop the flow of metal through the mold. FIG. 5 illustrates refractory trough 135, mold inlet 134, mold outlet 136, permeable perimeter wall 130, typically a graphite ring, water inlet conduits 133, and a round castpart 137 emerging from mold outlet 136.

Figure 6:
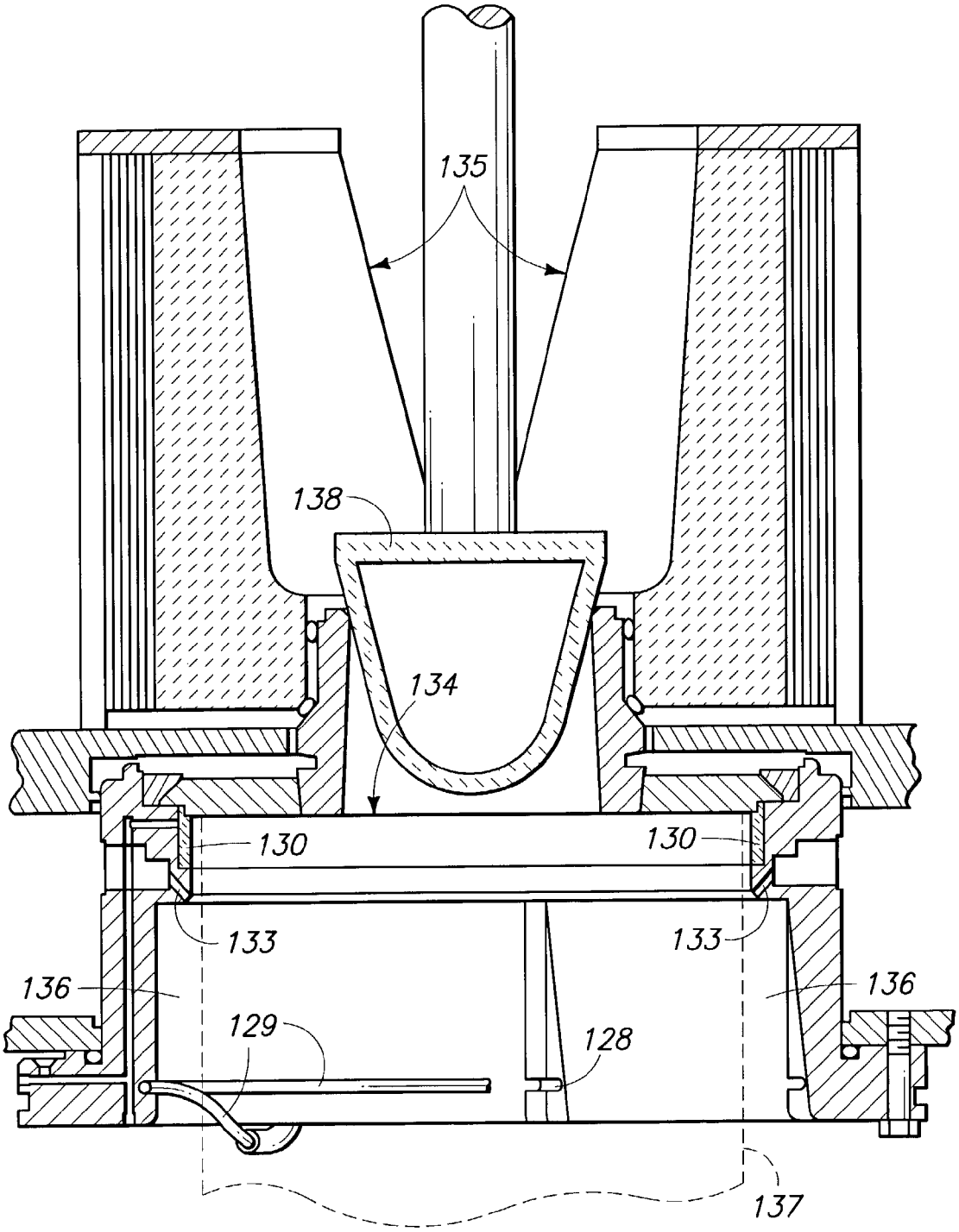
FIG. 6 is an elevation section view of one embodiment of a mold which may be utilized by this invention, wherein the metal flow stop device is a mold plug which is inserted into the mold inlet to stop the flow of metal to the mold.

FIG. 6 is an elevation section view of one embodiment of a mold which may be utilized by this invention, wherein the metal flow stop device is a mold plug 138 with a handle, the mold plug 138 being shown inserted into the mold inlet 134 to stop the flow of metal through the mold. FIG. 6 illustrates refractory trough 135, mold inlet 134, mold outlet 136, permeable perimeter wall 130, typically a graphite ring, water inlet conduits 133, and a round castpart 137 emerging from mold outlet 136.

Figure 7:
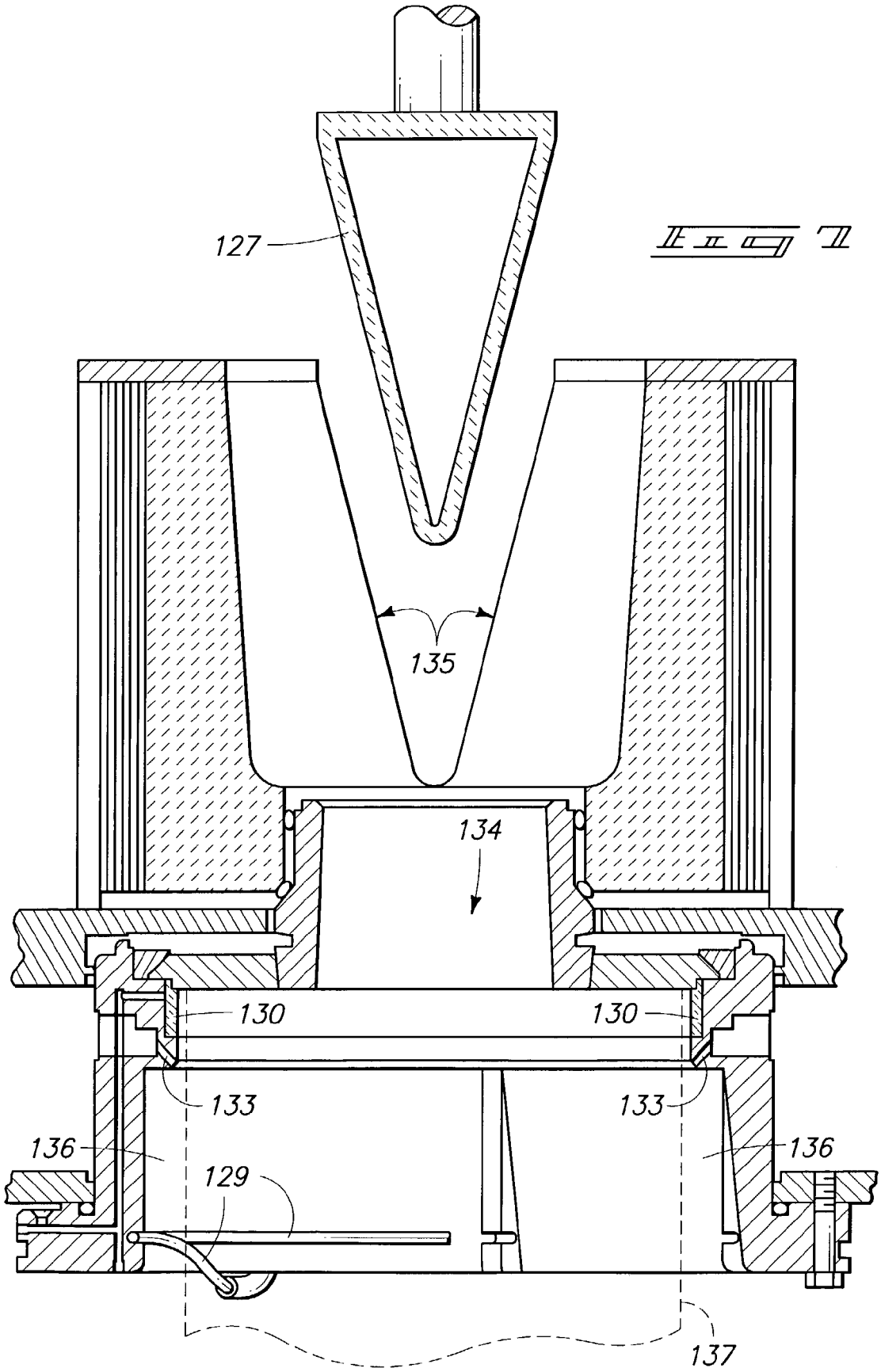
FIG. 7 is an elevation section view of one embodiment of a mold which may be utilized by this invention, wherein the metal flow stop device is a trough dam and is inserted into a metal supply flow trough to stop the flow of metal to the mold.
Figure 11B:
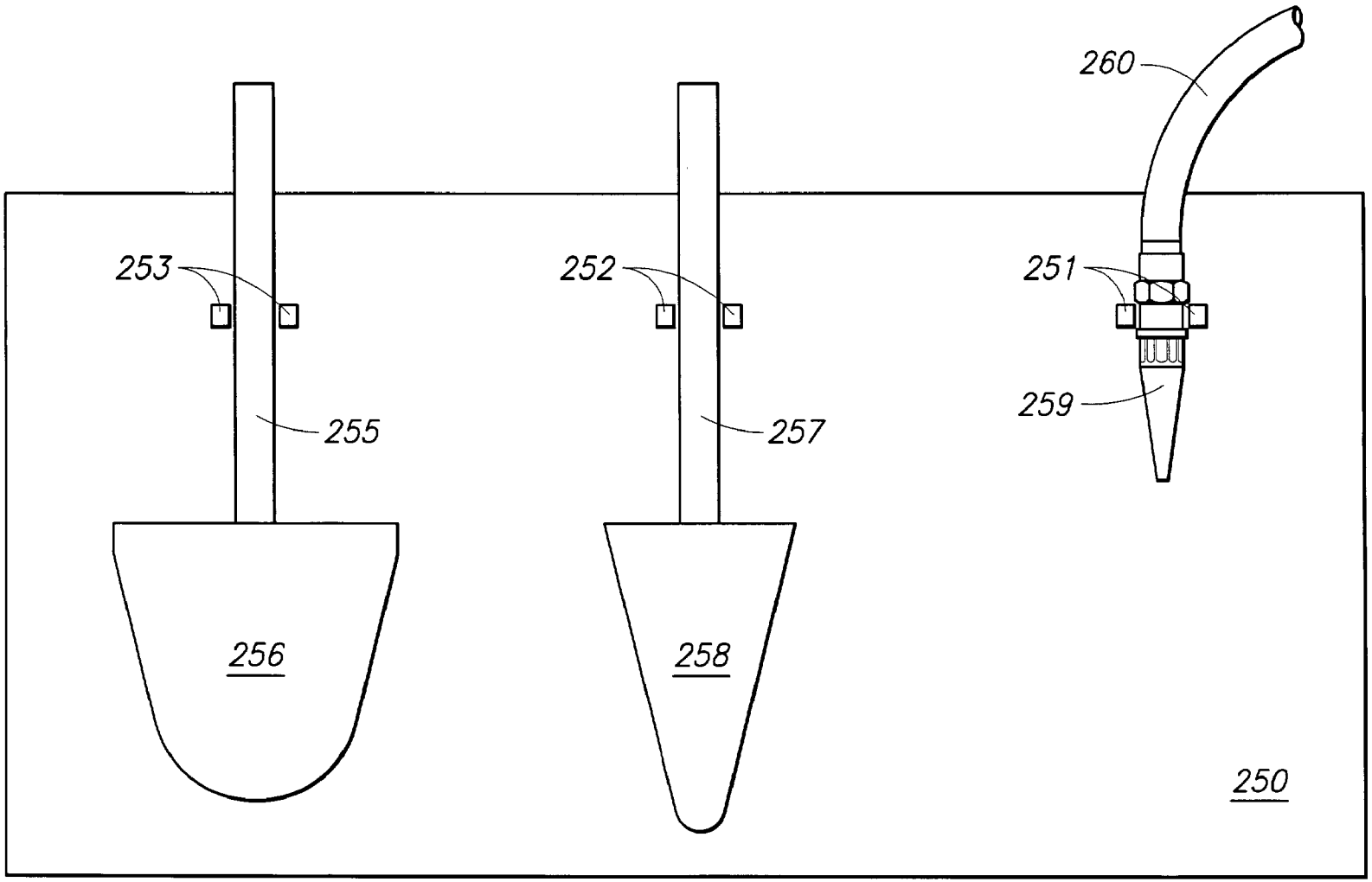
Figure 11:
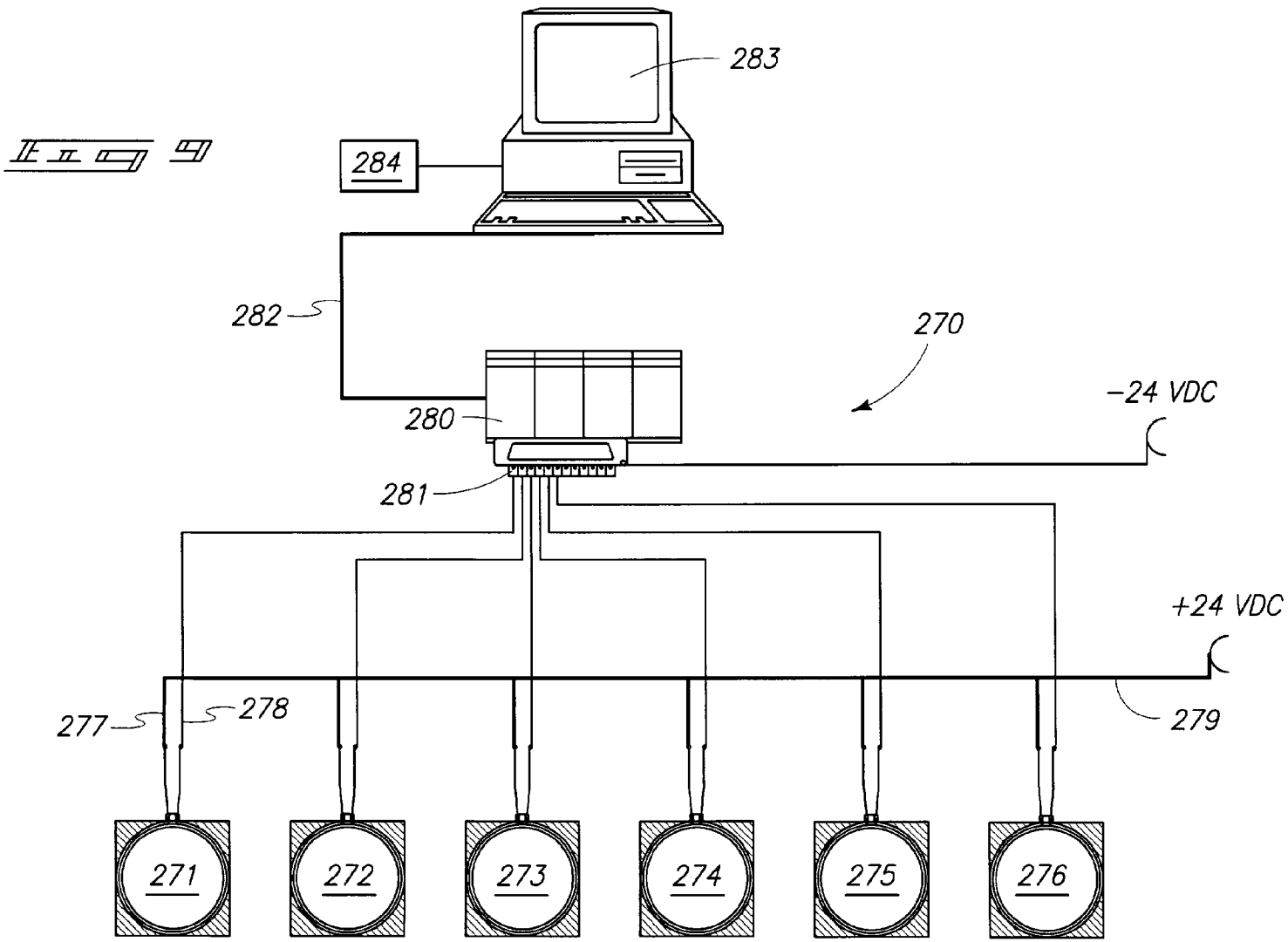
Figure 11:
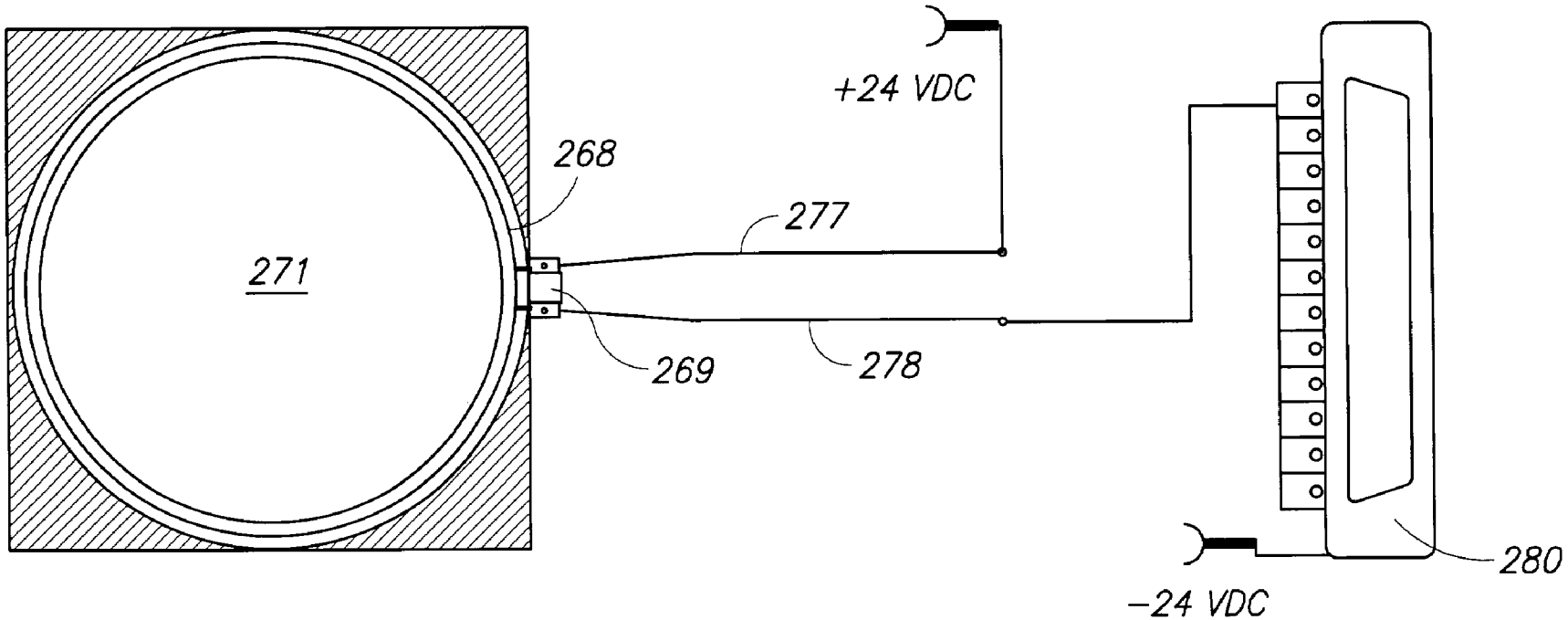
Figure 11:
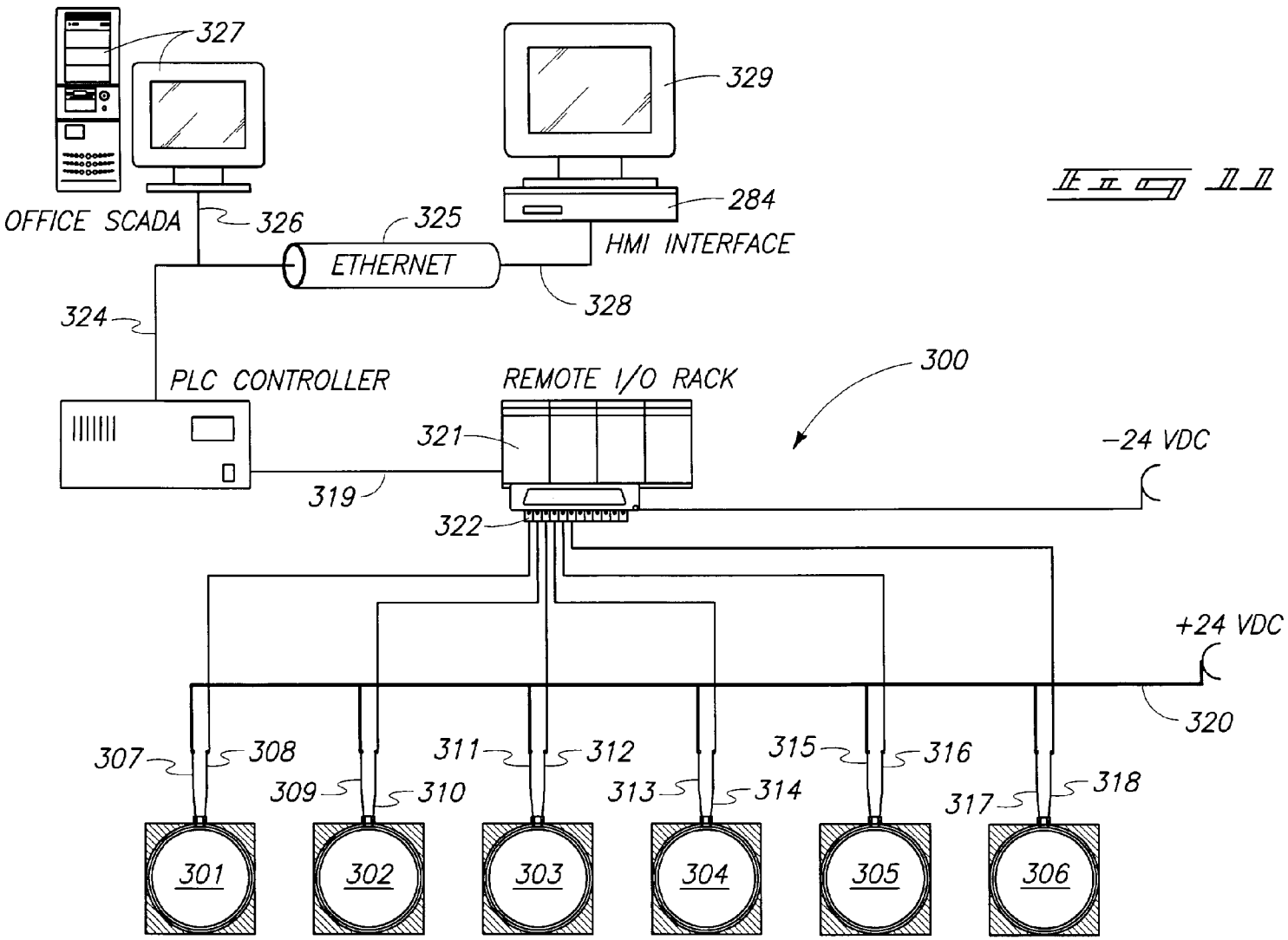
Figure 11:
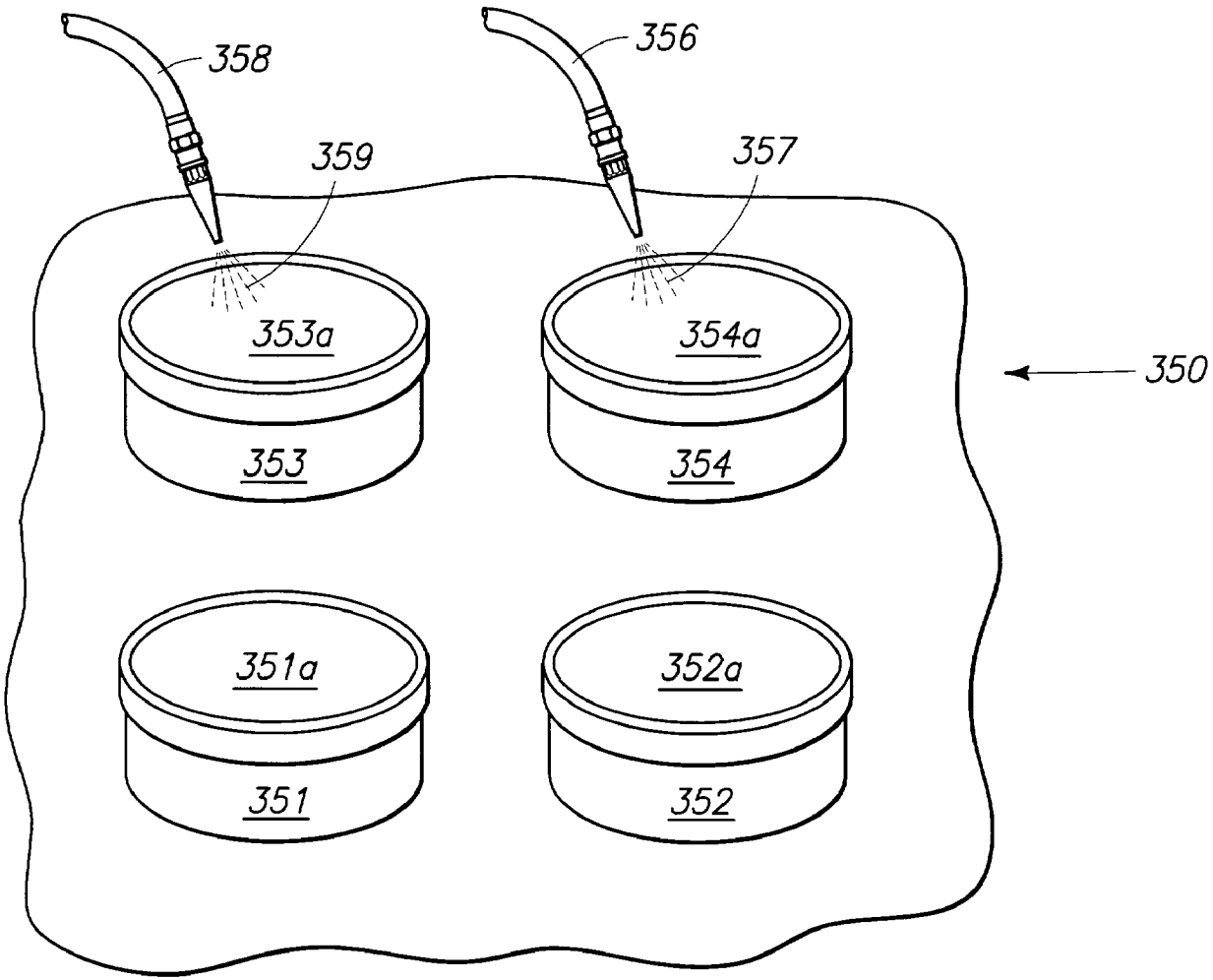
Figure 11:
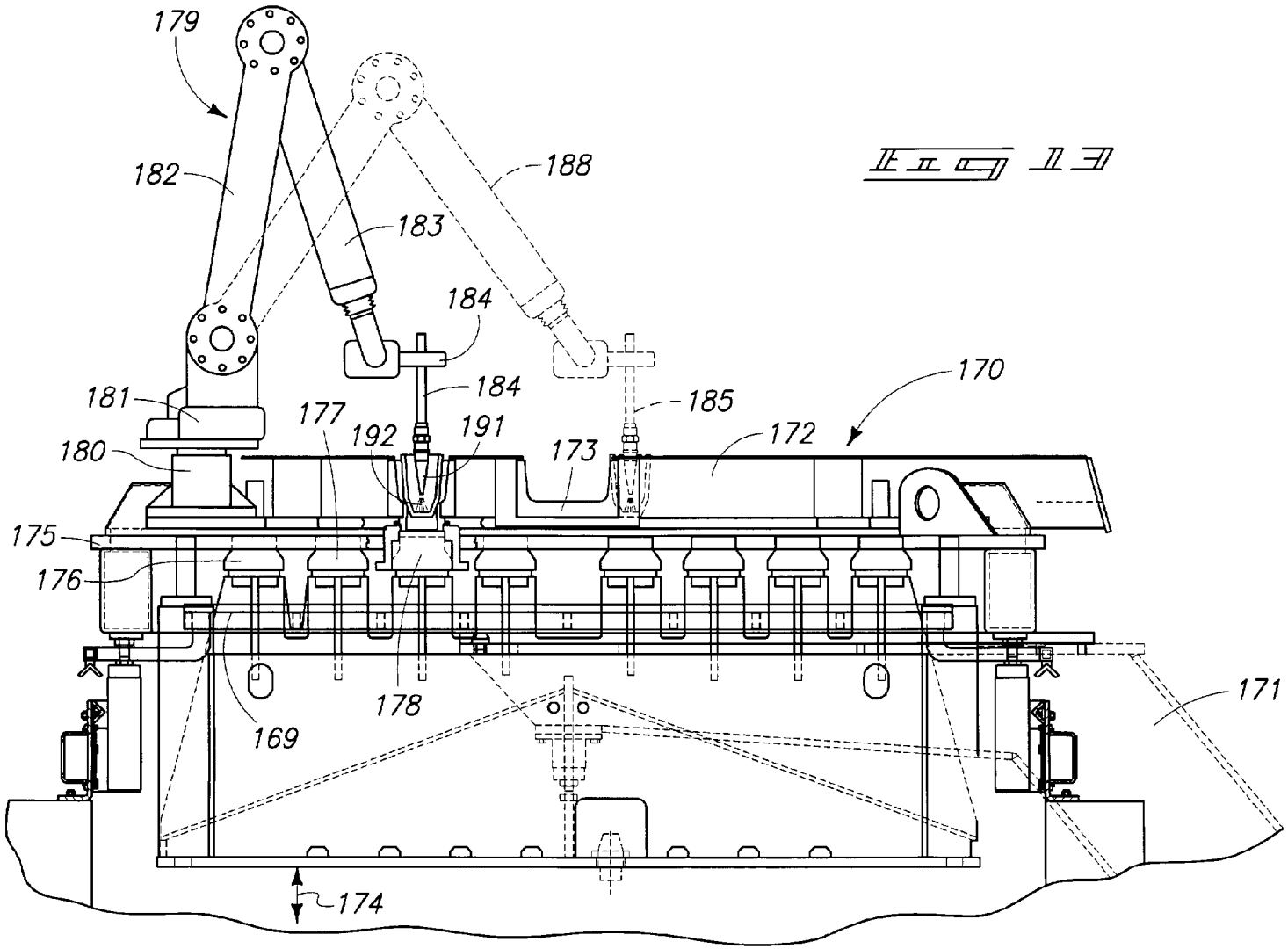
Figure 11:
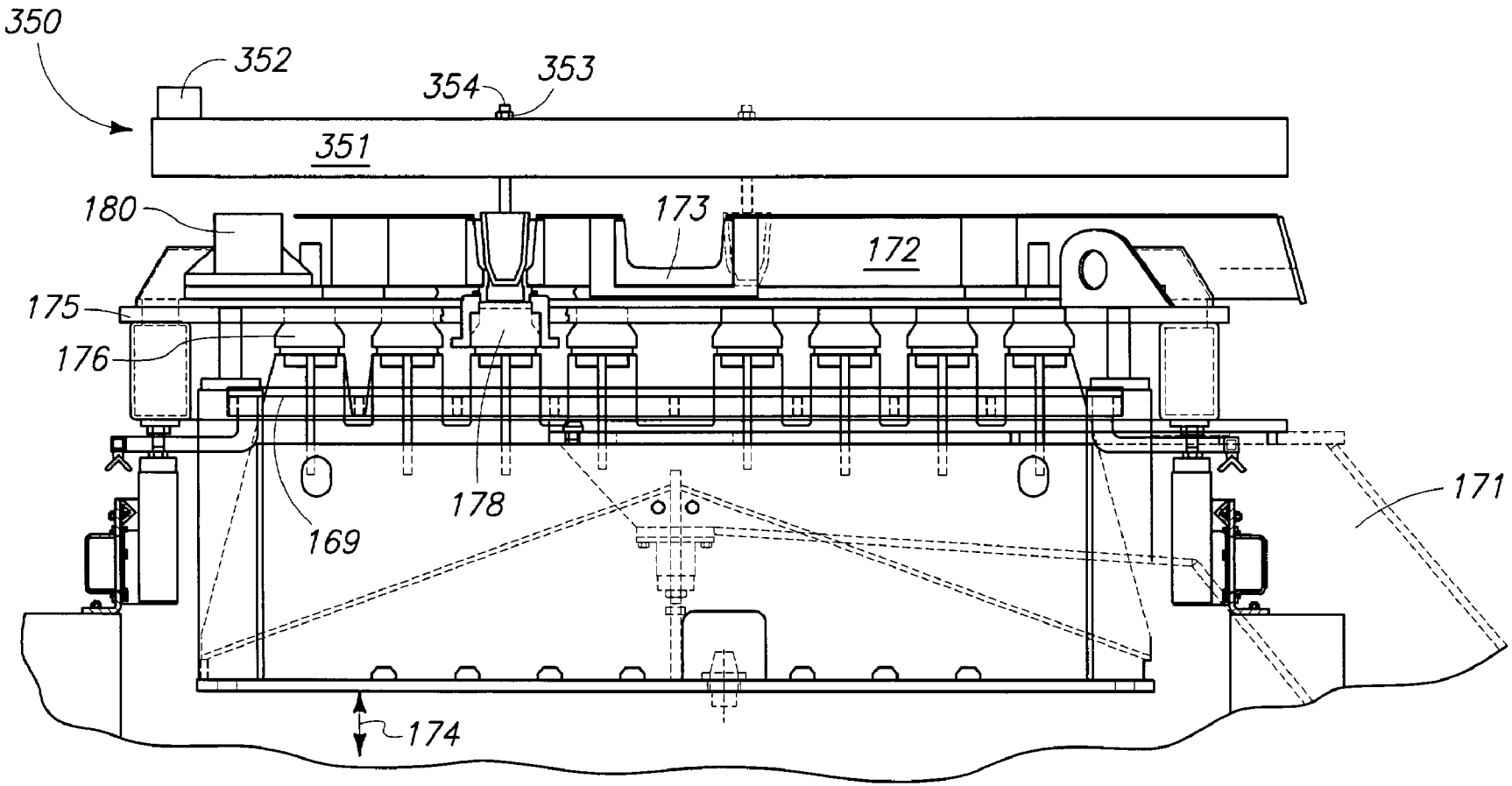

FIG. 7 is an elevation section view of one embodiment of a mold which may be utilized by this invention, wherein the metal flow stop device is a trough dam 127 and is inserted into a metal supply flow trough to stop the flow of metal through the mold. FIG. 7 illustrates refractory trough 135, mold inlet, mold outlet 136, permeable perimeter wall 130, typically a graphite ring, water inlet conduits 133, and a round castpart 137 emerging from mold outlet 136.

FIG. 7 also illustrates an aspect of the invention wherein a breakout detector 129 is positioned around or near the mold outlet 136 such that it is disposed to receive molten metal which has broken out, and then signal or indicate to the control system the fact and location of a breakout condition.

The breakout detector 129 may be an electrical conductor fuse wire which may be configured within a system embodiment in any one of a number of different configurations. For instance, the breakout detector 129 may be a fuse wire sensor which conducts 24 VDC to a table mounted remote Input/Output ("I/O") module (as shown in later figures), the insulated fuse wire may be configured to melt in the three hundred degrees Fahrenheit to four hundred and fifty degrees Fahrenheit temperature range. This would easily cause it to melt in response to a breakout condition. It will be appreciated by those of ordinary skill in the art that any one of a number of different control circuits and/or voltages may be utilized within the scope of the invention, which is not limited to any one.

The melting of the breakout detector 129, a fuse wire in this embodiment, may be configured to remove the 24 VDC from the input of the remote I/O module. In this configuration, a load resistor may be utilized to prevent the input signal from floating too high.

In another aspect of the breakout detector 129 configuration, there may be a 24 VDC supply power to the insulated fuse wire inside the mold cavity or mold outlet. A load resistor to −24 VDC may then cause a partial melt-through to completely open and drop the input to the remote I/O to 0 VDC. This configuration may be most desirable on smaller mold tables due to the higher requirement for supply current on larger tables.

In yet another embodiment of this invention relative to the breakout detector 129 configuration, a +24 VDC supply power may be provided to the insulated fuse wire in the mold cavity or mold outlet, with a −24 VDC grounded to the mold cavity. A partial melt-through to the mold cavity will short the 24 VDC supply and complete the melt-through, completely opening the input to the remote I/O module. As in other configurations or embodiments, a load resistor may be utilized to prevent the input signal from floating undesirably high.

FIG. 8 is a view of a plug and tool rack which may be used to hold plugs, dams, compressed air nozzle configurations, lubricant oil applicators, and release agent applicators, to name a few. FIG. 8 illustrates: rack framework 250; mold plug 256 with handle 255 retained to the rack framework 250 via holding structures 253; mold trough dam 258 with dam handle 257 retained to the rack framework 250 via holding structures 252; and nozzle 259 operatively attached to supply line 260 and retained to the rack framework 250 via holding structures 251. The nozzle may be a nozzle for compressed air with the supply line being a supply line operatively attached to a source of compressed air, or it may for instance be an oil nozzle configured to provide oil to starting heads, with the supply line being an oil supply line operatively connected to a source of oil.

It will also be appreciated by those of ordinary skill in the art that the rack framework 250 may be any one of a different number of shapes and configurations, such as a spindle or other configuration, all of which are generally known in the art.

FIG. 9 is schematic diagram of one embodiment of a control system configuration which may be utilized by this invention, schematically illustrating a plurality of molds or mold cavities 271, 272, 273, 274, 275 & 276, each having a bleedout detector within or around the interior of the mold cavity or mold outlet, disposed to detect a breakout condition. Each of the molds or mold cavities is electrically connected to digital input module that is part of a PLC (programmable logic controller) controller 280 via connections 281 (terminal connects from the sensor devices into the micro PLC controller). The common connection from the sensor power supply is connected to the Digital Input module common. In this example, the sensor supply and input modules were configured for 24 VDC as shown. Each of the mold cavity sensors are also electrically connected to the +24 VDC line 277 and the digital input module line 278. Each of the molds or mold cavities are also electrically connected to +24 VDC line 279. The input/output controller 280 is operationally connected via line 282 to control computer 283. The control computer 283 may then be programmed to receive the signals, identify the location or mold where a condition is sensed, and transmit instructions or signals to the articulated arm controller 284, which may also be an X-Y machine controller.

FIG. 10 is a schematic diagram of the operational connection of the bleedout detector to the +24 VDC via line and to the input output controller, illustrating mold cavity 271, bleedout detector 268 positioned around the perimeter of the mold cavity or mold outlet, input/output controller 280 connected to the bleedout detector 268 via line 278, and line 277 to +24 VDC.

Figure 11:
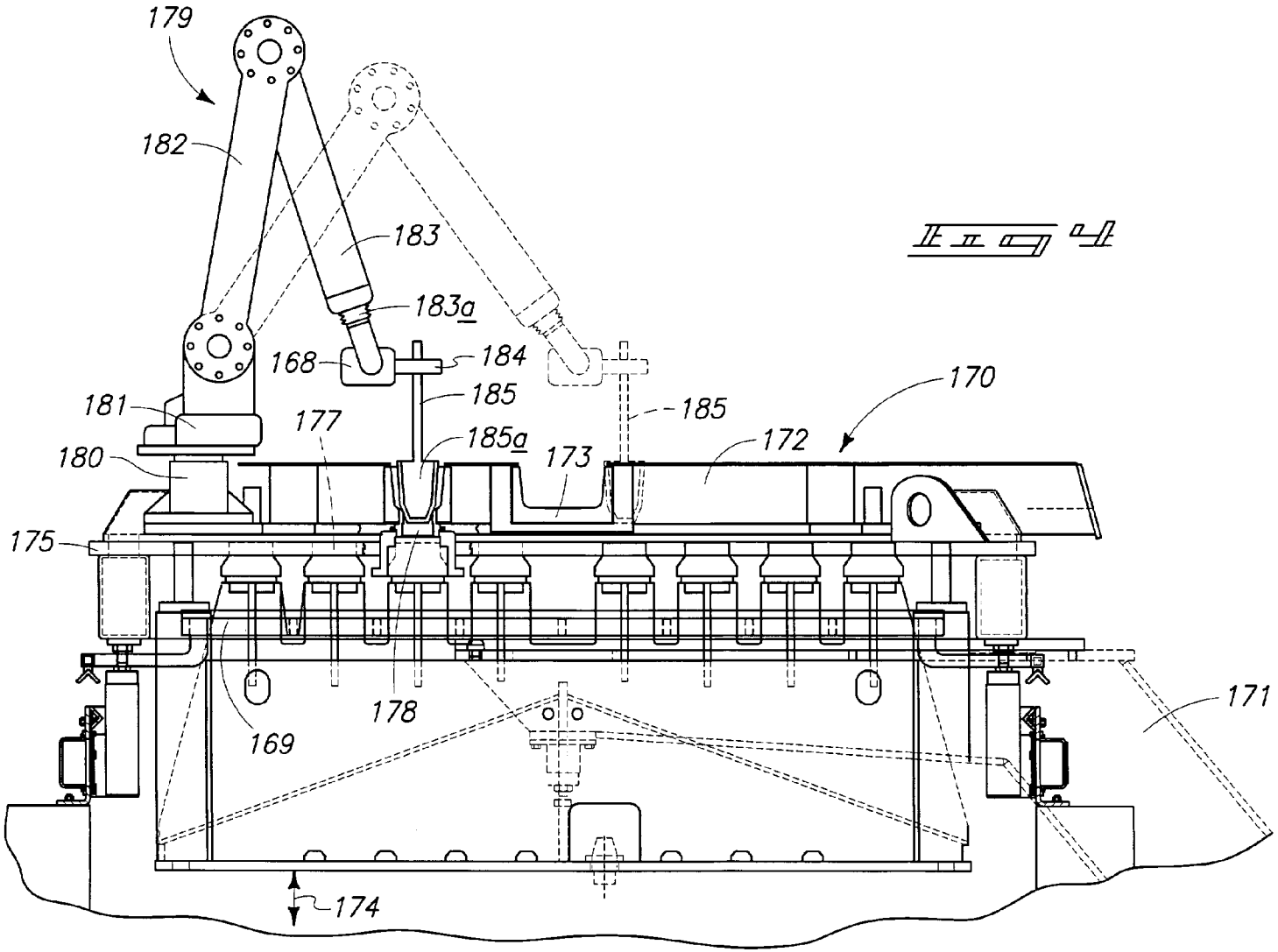
FIG. 11 is a schematic diagram of another embodiment of a control system configuration which may be utilized by this invention.

FIG. 11 is a schematic diagram of another embodiment of a control system 300 configuration which may be utilized by this invention, illustrating a plurality of molds or mold cavities 301, 302, 303, 304, 305 & 306, each having a bleedout detector within or around the interior of the mold cavity or mold outlet, disposed to detect a breakout condition. Each of the molds or mold cavities is electrically connected to input/output controller 321 with connections (terminal connects from the sensor devices into the remote input/output rack) via connections lines 308, 310, 312, 314, 316 and 318 respectively. The remote I/O rack may be configured at −24 VDC, as shown. Each of the molds or mold cavities are also electrically connected to +24 VDC line 320 via lines 307, 309, 311, 313, 315 and 317. The remote input/output rack 321 is operatively connected to a PLC controller 323. The PLC controller is operationally connected via ethernet 325 or some other communication protocol, which in turn is connected to the HMI (human machine interface) interface computer 329 via line 328, to the office SCADA (supervisory control and data acquisition) control computer 327 via line 326. The control computer 283 may then be programmed to receive the digital input module signals, identify the location or mold where a condition is sensed, and transmit instructions or signals to the articulated arm controller 323, which may also be an x-y machine controller. The remote input/output rack 321 may be connected to the plc controller via wireless connections or via conductor 319.

In an aspect of this invention, the bleedout detection sensor (as shown in FIG. 7 may be a fuse wire 129, which is an insulated temperature sensitive metal which can be selected based on a number of different factors, such as melting temperature. The fuse wire 129 may also be insulated by a plastic or other insulating material and threaded therein. In an aspect of the invention, a solder material may be used as the fuse wire. The fuse wire in this aspect can then be selected, determined or tailored to the specific application.

While the insulation layer around the fuse wire, solder for instance, may be applied by dipping the solder, it may also be a preformed sheath type insulation layer or structure into which the solder or other predetermined material is placed. In another embodiment, the bleedout detector may be placed adjacent the mold framework or housing such that when a bleedout condition occurs the insulation between the sensor or bleedout detector and the mold housing is removed and a short condition is created to ground, which is the mold housing, and which thereby results in the input/output card detecting a short condition.

In an aspect of the invention, the fuse wire may comprise a normal closed circuit loop around the mold cavity, and when its melting temperature is reached, it opens the normally closed circuit. Once the normally closed circuit is opened, the input/output card on the PLC detects an open or "no circuit" condition until the fuse wire is replaced. The input card on the PLC sends a bit to a controller, i.e. digital information, to a processor that displays the condition.

In other aspects of the invention, the breakout detection sensor may be: a twisted or adjacent pair of wires with at least one insulated, such that when a bleedout condition occurs, the insulation between the pair of wires is melted away and a short condition occurs, which in turn causes the input/output card to detect the short circuit condition.

FIG. 12 is a schematic depiction of an embodiment of the invention wherein a compressed air nozzle 356 is utilized to apply air 357 to remove water and other undesired elements from the surface 354*a* of starting head 354, and also showing an oil applicator 358 applying oil (or lubricant) 359 to surface 353*a* of starting head 353. FIG. 12 illustrates a portion of a starting head array 350, including starting heads 351, 352, 353 and 354, each with top surfaces 351*a*, 352*a*, 353*a* and 354*a* respectively. The controlled articulated arm or X-Y system may be programmed to sequentially, according to a desired sequence, apply compressed air to the surfaces to remove moisture and other undesirable elements, and then to similarly apply oil 359 or lubricant to the surfaces to prepare them for the casting process.

FIG. 13 is an elevation view of a mold table with a controlled arm mounted thereon similar to FIG. 4, only which illustrates the application of compressed air or oil to the starting heads instead of the insertion of a mold plug through a mold cavity. FIG. 13 illustrates mold table 170 with a controlled arm 179 mounted thereon and providing a nozzle 191 providing a fluid spray 192 (oil or air) to a starting head in a mold cavity 178. FIG. 13 illustrates mold table framework 175, casting pit 171, and starting block base 169. The starting block base 169 moves vertically during casting as represented by arrow 174. This embodiment is shown with a molten metal pour system 172 generally comprised of refractory troughs such as trough 173. FIG. 13 also shows a first mold cavity 176, second mold cavity 177 and third mold cavity 178, in addition to others not shown with item numbers.

FIG. 14 is an elevation view of a mold table with a controlled X-Y framework utilized in an aspect of the invention instead of the articulated arm, providing a mold plug to a mold cavity. The mold table components are the same or similar to that shown in FIG. 4 and are shown with the same numbers, and will not therefore be discussed in any further detail. As stated above, it will be appreciated by those of ordinary skill in the art that while the term x-y machine, device or framework may be utilized herein, those devices in this art may and do also include movement in a third direction, the z direction.

FIG. 14 shows an X-Y machine 350 with controller 352 mounted thereon, positioned above the mold table, and illustrating machine framework 351. The X-Y machine has attachment mechanism 353 to allow it to hold the various desired tools, such as mold plug 354.

Figure 15:
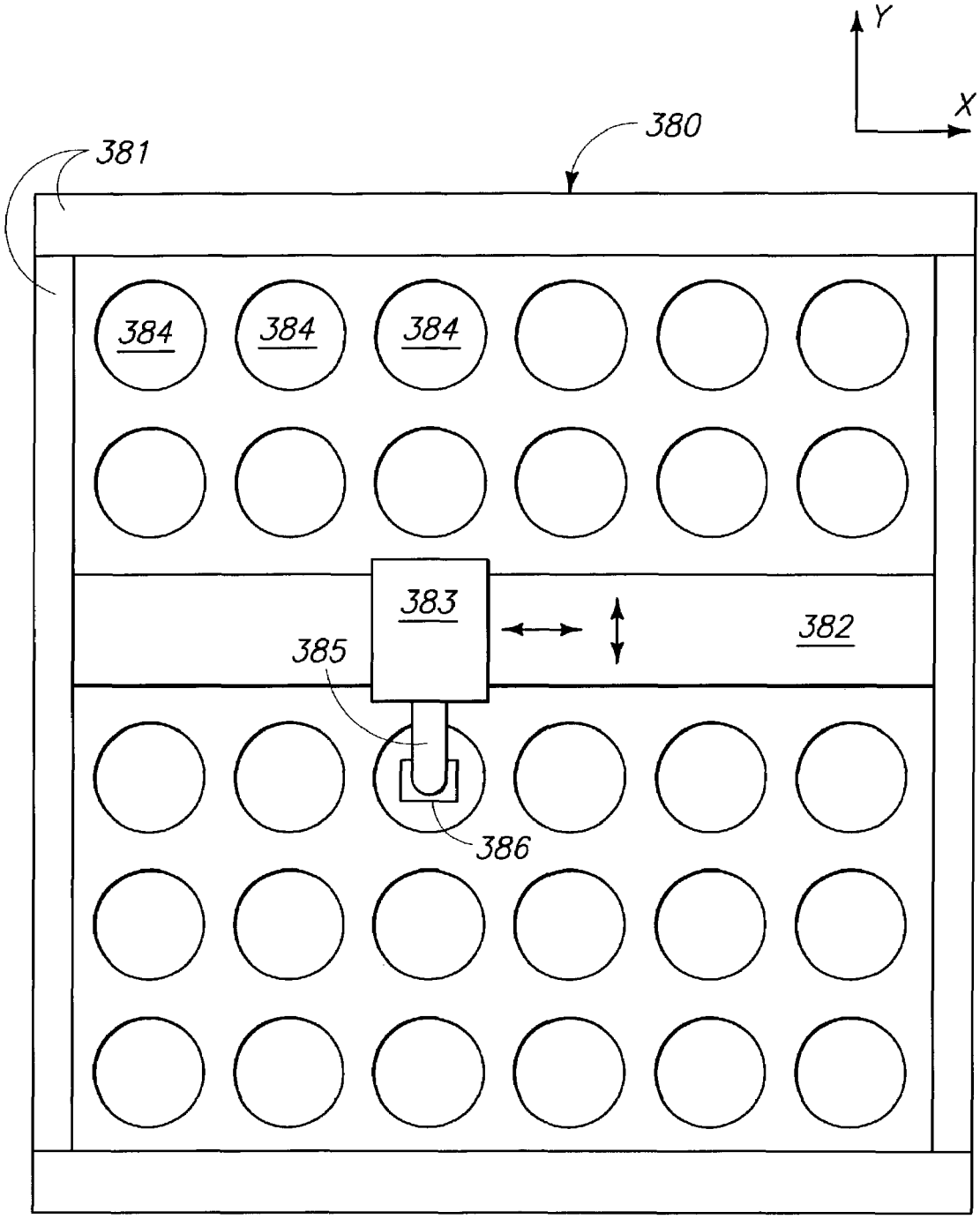
FIG. 15 is a top schematic view of an embodiment of an X-Y machine which may be utilized as part of this invention.
Figure 11:
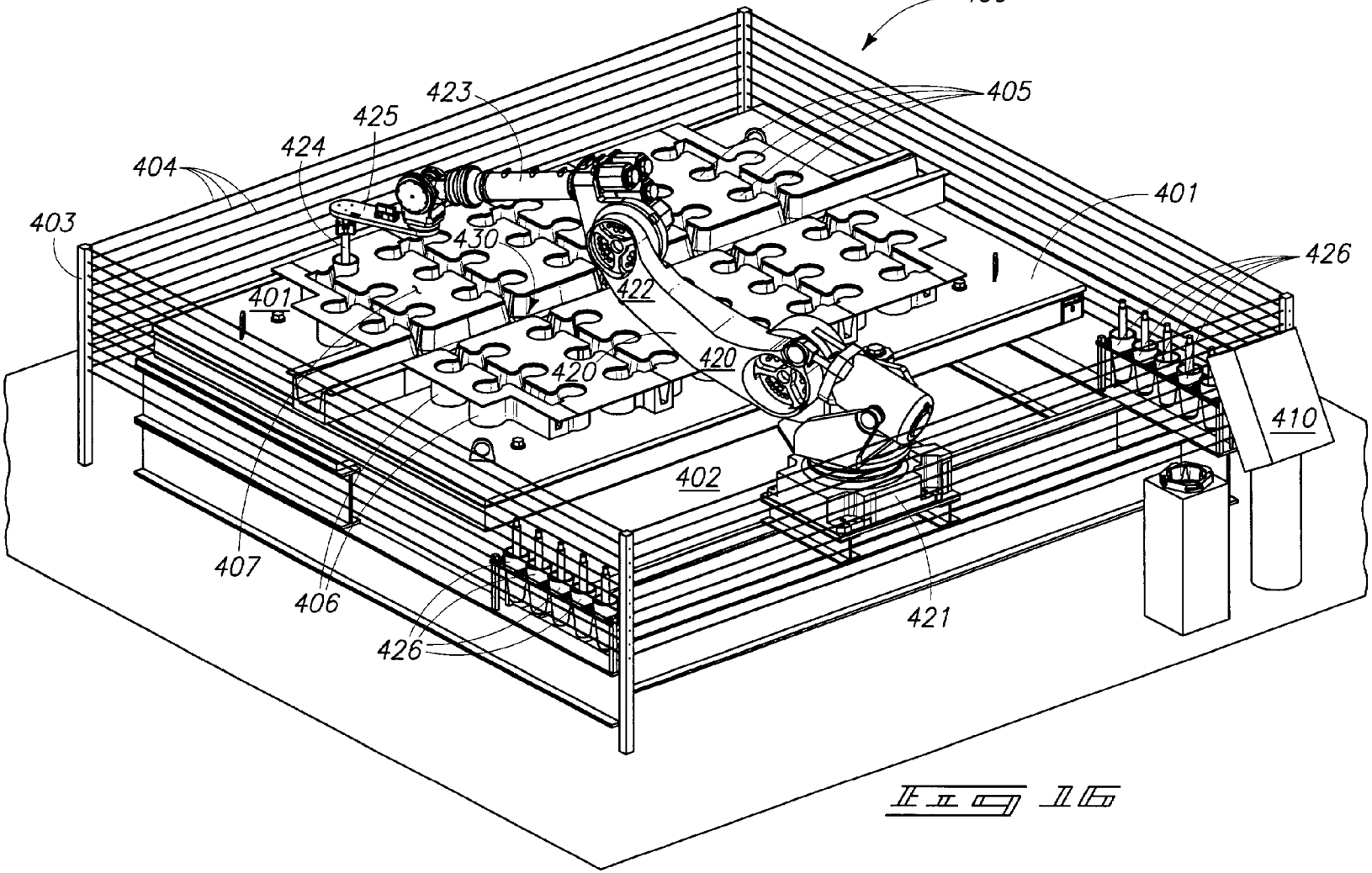
Figure 11:
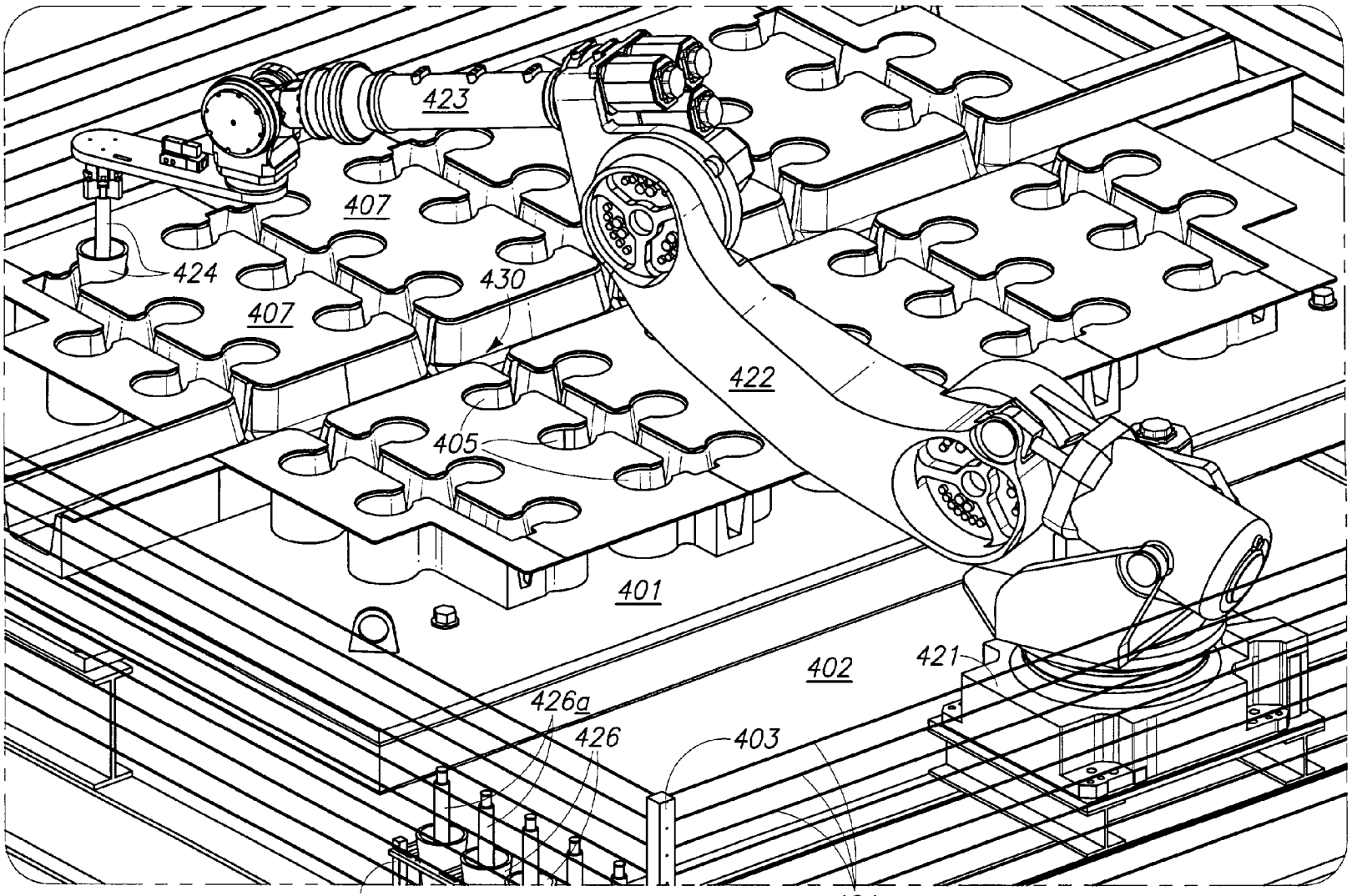

FIG. 15 is a top schematic view of an embodiment of an X-Y machine 380 which may be utilized as part of this invention, illustrating framework 381 positioned above a plurality of mold cavities 384. Attachment mechanism 385 is mounted to carriage 383, which is slidable mounted on support 382 to provide movement in the X direction. Support 382 is slidably mounted within framework 381 to provide movement in the Y direction. In the embodiment shown in FIG. 15, the attachment mechanism 385 is shown holding mold plug 386, although a mold plug is merely one of a number of different tools it may utilize.

In an embodiment of this invention, the control system will operate the controlled arm or X-Y machine to obtain an air nozzle operatively attached to a source of compressed air, and sequentially move to each starting head for the mold table and release sufficient air to remove the liquid from the surface thereof. This may be done with the casting table over the starting heads or with the casting table moved or tilted away. The controlled arm or X-Y machine then obtains an oil or lubricant nozzle and sequentially moves to each starting head for the mold table and sprays an oil or lubricant on the starting head to prepare its surface for the casting process. The control system combined with the controlled arm may also be utilized to obtain a spray nozzle operatively attached to a source of a release agent to spray on the mold table to prepare it for the casting process.

The control system is operatively connected to the bleedout detectors and once the casting process commences, the control system stands ready to respond to a bleedout condition sensed. In such a case, depending on the location of the bleedout, the controlled arm or X-Y machine will obtain a mold plug or trough dam and insert it in a location to stop the flow of molten metal through the mold cavity where the bleedout occurred.

FIG. 16 is a perspective elevation view of one embodiment of this invention, illustrating a casting area 400, with perimeter fence 403 which includes light or laser beams 404 creating a virtual fence around the casting pit area. The perimeter fence can accomplish one or more tasks if the beams are disrupted, such as stopping the casting process, disabling the controlled arm 420, activate an alarm, or others.

Mold table 401 is mounted above casting pit 402. This mold table includes a molten metal feed system which includes refractory troughs 430 with openings 405 providing access to the molds below each opening 405. The molten metal feed system is one of a number of feed systems which may be utilized with embodiments of this invention, with no one in particular being required to practice this invention. In FIG. 16, troughs 430 are generally comprised of refractory material, with a top 407, which is generally made of a metallic material.

The embodiment of the controlled arm 420 shown in FIG. 16 is comprised of a base 421 mounted to an area adjacent the mold table, although it may also be mounted on a mold table in other embodiments. The remainder of the controlled arm 420 is pivotally mounted to the base 421, and is further comprised of first arm section 422, second arm section 423, and adapter section 425. The controlled arm 420 may be any one of a number of controlled arms, such as that marketed by Fanuc Robotics America, or Panasonic America. Typically a controlled arm 420 would include one or more adapters which may be utilized for different applications and tasks, with no one configuration being required. In the embodiment shown, the controlled arm is attached to the handle of a mold plug 424, which it is inserting into a mold cavity through the refractory troughs shown.

In embodiments of this invention in which the controlled arm is utilized for the application of air or lubricant to the starting heads, as described more full above, the conduits or hoses, or a portion thereof, may be mounted to the controlled arm 420, or they can be wholly mounted elsewhere and grabbed by a suitable adapter of the controlled arm 420.

FIG. 17 is a perspective view of the embodiment of the invention illustrated in FIG. 16, only a closer view. FIG. 17 illustrates the controlled arm 420 is inserting a mold plug 424 through the refractory molten metal feed system and into a mold cavity. FIG. 17 shows perimeter fence 403 with light or laser beams 404, casting pit 402, casting or mold table 401, refractory molten metal troughs 430, mold apertures 405 in the refractory above mold cavities, mold plugs 426 with mold plug handles **426*a* stored, retained or held in a framework 430 for access by the controlled arm 430**.

FIG. 17 further shows first arm section 422, second arm section 423, refractory top portion 407, and controlled arm base 421.

It will appreciated by those of ordinary skill in the art the potential benefit that embodiments of this invention provide, which may be a people-less pit area. While numerous safety precautions are continually taken, there is always at least some danger when people are around high temperature material such as molten aluminum and/or heavy equipment. Embodiments of this invention will remove people from the area during operation and in the event of a bleedout. Prior methods include having an operator manually grab a mold plug, venture out on the mold table and insert the mold plug into the mold cavity to stop the flow of molten aluminum. Prior systems also generally required operators to manually venture to the pit area to apply air to the starting heads and lubrication to the starting heads before the table was placed over the heads, to prepare them for the casting process. Embodiments of this invention eliminate the need to have operators perform such tasks, has these tasks and others may be performed by the controlled arm or the x-y machine described above.

It will be appreciated by those of ordinary skill in the art that there are any one of a number of different controlled arms and control systems for the controlled arms, which are available and which may be utilized in embodiments of this invention, with no one in particular being required to practice said embodiments. With the available systems available in the art, the available control systems provide the tools to cause any particular controlled arm to perform the tasks and functions provided herein.

Therefore, in a typical sequence in an embodiment of this invention, the controlled arm may be programmed to utilize an air nozzle on each starting head, either with the mold table moved out of the way or through the mold cavities. Once the air and other contaminants are removed, then the controlled arm may utilize a lubricant nozzle to apply a lubricant or oil to the starting heads, as is known in the art. Once the starting heads are sufficiently prepared, the mold table may be moved back over the starting heads, or tilted back down over the starting heads to begin the introduction of molten metal to the mold cavities to begin the casting process.

During casting, each of the mold cavities then includes a bleedout detector to sense or detect a bleedout condition. Once a bleedout condition is detected, the controller identifies the mold cavity or mold cavities and instructs the controlled arm to obtain a mold plug from the mold plug framework and insert it in that or those mold cavities. The system may, but need not, also cause the casting process to be altered or stopped.

As will be appreciated by those of reasonable skill in the art, there are numerous embodiments to this invention, and variations of elements and components which may be used, all within the scope of this invention.

For example one embodiment of the invention may be a system for stopping the flow of molten metal through at least one of a plurality of mold cavities, each of which are positioned at an x-y coordinate on a mold table, each mold cavity including a mold cavity inlet and a mold cavity outlet, the system being comprised of: a plurality of sensors, each positioned relative to one of a plurality of mold cavity outlets such as to detect the occurrence of a molten metal bleedout condition and each of the plurality of sensors configured to provide a bleedout condition signal; a mold cavity plug corresponding in size to the plurality of mold cavity inlets such that when inserted at or near the mold cavity inlet, the mold cavity plug stops the flow of molten metal through the mold cavity; a robotic arm controlled by a robotic arm controller, the robotic arm having an arm reach and being disposed in retrieving disposition relative to the mold cavity plug, and further wherein the robotic arm is extendible to insert the mold cavity plug at or near one of the plurality of mold cavity inlets to stop the flow of molten metal through that mold cavity; and the robotic arm controller is configured to utilize a first bleedout condition signal and a first predetermined x-y coordinate for the mold cavity at which the first molten metal bleedout condition occurred, and further to control the robotic arm to place the mold cavity plug at or near the mold cavity inlet to stop the flow of molten metal through the mold cavity at which the molten metal bleedout condition occurred. A further embodiment thereof may further comprise: a plurality of mold cavity plugs corresponding in size to the plurality of mold cavity inlets such that when inserted at or near the mold cavity inlets, the mold cavity plugs stop the flow of molten metal through the mold cavities; and further wherein the robotic arm controller is configured to utilize a plurality of bleedout condition signals and a plurality of corresponding predetermined x-y coordinates for the mold cavities at which the molten metal bleedout conditions occurred, and further to control the robotic arm to place the plurality of mold cavity plugs at or near the mold cavity inlets to stop the flow of molten metal through the mold cavities at which the molten metal bleedout conditions occurred.

In a still further embodiment of the foregoing, a system may be provided which further comprises: a plurality of starting heads, each positioned below one of the plurality of mold cavities during casting, each starting head having a predetermined x-y coordinate; wherein the robotic arm is further controlled to impart a flow of gas on the plurality of starting heads prior to casting; and/or wherein the robotic arm is further controlled to impart a lubricant on the plurality of starting heads prior to casting.

The foregoing system may be further embodied such that the sensor is a fuse wire sensor comprised of a central base metal with a predetermined melting temperature which is below a temperature of molten metal to be cast through the casting mold; and an insulation layer circumferentially around the central base metal, said insulation layer including a predetermined melting temperature. The fuse wire may for instance be solder.

In a method embodiment of the invention, a method for stopping the flow of molten metal through mold cavities on a molten metal mold table may be provided, comprised of: providing a molten metal mold table with a plurality of mold cavities, each of the plurality of mold cavities positioned at an x-y coordinate on the mold table and each of the plurality of mold cavities having a mold cavity inlet and a mold cavity outlet; providing a plurality of sensors, each positioned relative to one of a plurality of mold cavity outlets such as to detect the occurrence of a molten metal bleedout condition and each of the plurality of sensors configured to provide a bleedout condition signal; providing a mold cavity plug corresponding in size to the plurality of mold cavity inlets such that when inserted at or near the mold cavity inlet, the mold cavity plug stops the flow of molten metal through the mold cavity; providing a robotic arm controlled by a robotic arm controller, the robotic arm being disposed to retrieve the mold cavity plug and to insert the mold cavity plug at or near one of the plurality of mold cavity inlets to stop the flow of molten metal through that mold cavity; providing the robotic arm controller configured to utilize the bleedout condition signal and a predetermined x-y coordinate for the mold cavity at which the molten metal bleedout condition occurred, and further to control the robotic arm to place the mold cavity plug at or near the mold cavity inlet to stop the flow of molten metal through the mold cavity at which the molten metal bleedout condition occurred; commencing of casting of molten metal through the mold table; sensing a molten metal bleedout condition from one of the plurality of mold cavities; providing the x-y coordinate for the molten metal bleedout condition from the one of the plurality of mold cavities to the robotic arm controller; controlling the robotic arm to retrieve one of the plurality of mold cavity plugs; and controlling the robotic arm to insert the one of the plurality of mold cavity plugs at or near the mold cavity inlet where the molten metal bleedout condition was sensed, thereby stopping the flow of molten metal through the mold cavity.

The embodiment in the preceding paragraph may be further comprised of: providing the robotic arm controller configured to utilize a gas nozzle to apply gas to the plurality of starting heads; and prior to commencement of casting, controlling the robotic arm to apply a flow of gas to the plurality of starting heads. The gas may preferably be air.

In another embodiment of the invention, an automated molten metal casting system for casting molten metal with a mold table in a casting area may be provided, wherein the casting system is comprised of: a mold table in a molten metal casting area, the mold table including a plurality of molds each with a corresponding mold cavity and each disposed to receive molten metal; a plurality of starting heads each corresponding to one of the plurality of molds; a controlled arm mounted in the casting area, the controlled arm being configured to access the plurality of molds; and a casting area perimeter around the casting area and which defines an area in which humans are not required during casting. This embodiment may be further comprised of a plurality of molten metal bleedout detection sensors, each bleedout detection sensor being positioned at one of the plurality of molds and each bleedout detection sensor being operatively connected to the controlled arm; a plurality of mold plugs configured to be accessed by the controlled arm; and wherein the controlled arm is configured such that when a bleedout condition is sensed at one of the plurality of molds, the controlled arm attaches to one of the plurality of mold plugs and inserts the one of the plurality of mold plugs into the mold in which the bleedout is detected, thereby blocking the flow of molten metal through the mold in which the bleedout is detected.

The foregoing system may be further embodied such that the sensor is a fuse wire sensor comprised of a central base metal with a predetermined melting temperature which is below a temperature of molten metal to be cast through the casting mold; and an insulation layer circumferentially around the central base metal, said insulation layer including a predetermined melting temperature. The fuse wire may for instance be solder. The embodiment in the preceding paragraph may also be further comprised of: providing the robotic arm controller configured to utilize a gas nozzle to apply gas to the plurality of starting heads; and prior to commencement of casting, controlling the robotic arm to apply a flow of gas to the plurality of starting heads. The gas may preferably be air.

The embodiment in the second preceding paragraph may also be further comprised of providing the robotic arm controller configured to utilize a liquid nozzle mounted within the casting area, the liquid nozzle being configured to be accessed by the controlled arm; and wherein the controlled arm is configured attach to the liquid nozzle and move the liquid nozzle sequentially to the plurality of starting heads to apply liquid thereto. The liquid may a lubricant and/or a release agent.

In another embodiment of the invention, a control system for use with molten metal casting system which includes a mold table in a casting area, the mold table including a plurality of molds and a plurality of starting heads corresponding to the plurality of molds, the control system may be provided comprising: a plurality of bleedout detection sensors configured for placement in the plurality of molds; and a controlled x-y device operably connected to the plurality of bleedout detection sensors, the x-y device comprising: a mechanical hand configured to attach to a molten metal mold plug, the x-y device being further configured to cause the mechanical hand to attach to a mold plug and move the mold plug to one of the plurality of molds in which a bleedout condition is sensed.

The control system embodiment in the preceding paragraph may further be: mounted within the casting area; and/or a controlled arm.

In another embodiment of the invention, an automation system for casting molten metal with a mold table is provided, the system comprising the following: a mold table in a molten metal casting area, the mold table including a plurality of molds each with a corresponding mold cavity; a plurality of starting heads each corresponding to one of the plurality of molds; a controlled arm mounted in the casting area, the controlled arm being configured to access the plurality of molds; a plurality of molten metal bleedout detection sensors, each bleedout detection sensor being positioned at one of the plurality of molds; initiation of casting of molten metal through the mold table; sensing a bleedout condition with one of the plurality of bleedout detection sensors in one of the plurality of molds; and moving the controlled arm to place a mold plug in the mold in which the bleedout condition is sensed.

The foregoing system may be further embodied such that the sensor is a fuse wire sensor comprised of a central base metal with a predetermined melting temperature which is below a temperature of molten metal to be cast through the casting mold; and an insulation layer circumferentially around the central base metal, said insulation layer including a predetermined melting temperature. The fuse wire may for instance be solder.

Another method embodiment may be provided, a method for automating the casting of molten metal in a mold table in a casting area, the mold table including a plurality of molds each with a corresponding mold cavity, comprising the following: providing a controlled arm mounted in the casting area, the controlled arm being configured to access the plurality of molds; providing a plurality of molten metal bleedout detection sensors, each bleedout detection sensor being positioned at one of the plurality of molds; initiation of casting of molten metal through the mold table; sensing a bleedout condition with one of the plurality of bleedout detection sensors; and moving the controlled arm to attach to a mold plug; moving the controlled arm with the mold plug attached, to the mold in which the bleedout condition is sensed; and inserting the mold plug into the mold cavity of the mold in which the bleedout condition is sensed, thereby stopping the flow of molten metal through said mold.

In yet another embodiment, a fuse wire sensor is provided for use as a molten metal bleedout detector in a molten metal casting mold, the fuse wire sensor being comprised of: a central base metal with a predetermined melting temperature which is below a temperature of molten metal to be cast through the casting mold; an insulation layer circumferentially around the central base metal, said insulation layer including a predetermined melting temperature. The fuse wire sensor central base metal may, but need not be solder. It will be appreciated by those of ordinary skill in the art that any one of a number of different materials may be utilized within the contemplation of this invention, with no one in particular being required to practice it.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. A system for stopping the flow of molten metal through at least one of a plurality of mold cavities, each of which are positioned at an x-y coordinate on a mold table, each mold cavity including a mold cavity inlet and a mold cavity outlet, the system being comprised of:

a plurality of sensors, each positioned relative to one of a plurality of mold cavity outlets such as to detect the occurrence of a molten metal bleedout condition and each of the plurality of sensors configured to provide a bleedout condition signal;

a mold cavity plug corresponding in size to the plurality of mold cavity inlets such that when inserted at or near the mold cavity inlet, the mold cavity plug stops the flow of molten metal through the mold cavity;

a robotic arm controlled by a robotic arm controller, the robotic arm being movable in three dimensions and having an arm reach and being disposed in retrieving disposition relative to the mold cavity plug, and further wherein the robotic arm is extendible from a single location to insert the mold cavity plug at or near any one of the plurality of mold cavity inlets to stop the flow of molten metal through that mold cavity; and the robotic arm controller is configured to utilize a first bleedout condition signal and a first predetermined x-y coordinate for the mold cavity at which the first molten metal bleedout condition occurred, and further to control the robotic arm to place the mold cavity plug at or near any one of the plurality of mold cavity inlets to stop the flow of molten metal through the mold cavity at which the molten metal bleedout condition occurred.

2. A system for stopping the flow of molten metal through at least one of a plurality of mold cavities as recited in claim 1, and further comprising:

a plurality of mold cavity plugs corresponding in size to the plurality of mold cavity inlets such that when inserted at or near the mold cavity inlets, the mold cavity plugs stop the flow of molten metal through the mold cavities; and further wherein the robotic arm controller is configured to utilize a plurality of bleedout condition signals and a plurality of corresponding predetermined x-y coordinates for the mold cavities at which the molten metal bleedout conditions occurred, and further to control the robotic arm to place the plurality of mold cavity plugs at or near the mold cavity inlets to stop the flow of molten metal through the mold cavities at which the molten metal bleedout conditions occurred.

3. A system for stopping the flow of molten metal through at least one of a plurality of mold cavities as recited in claim 1, and further comprising:

a plurality of starting heads, each positioned below one of the plurality of mold cavities during casting, each starting head having a predetermined x-y coordinate;

wherein the robotic arm is further controlled to impart a flow of gas on the plurality of starting heads prior to casting.

4. A system for stopping the flow of molten metal through at least one of a plurality of mold cavities as recited in claim 3, and wherein the robotic arm is further controlled to impart a lubricant on the plurality of starting heads prior to casting.

5. A system for stopping the flow of molten metal through at least one of a plurality of mold cavities as recited in claim 1, and further wherein the sensor is a fuse wire sensor comprised of a central base metal with a predetermined melting temperature which is below a temperature of molten metal to be cast through the casting mold; and an insulation layer circumferentially around the central base metal, said insulation layer including a predetermined melting temperature.

6. A method for stopping the flow of molten metal through mold cavities on a molten metal mold table, comprised of the following:

providing a molten metal mold table with a plurality of mold cavities, each of the plurality of mold cavities positioned at an x-y coordinate on the mold table and each of the plurality of mold cavities having a mold cavity inlet and a mold cavity outlet;

providing a plurality of sensors, each positioned relative to one of a plurality of mold cavity outlets such as to detect the occurrence of a molten metal bleedout condition and each of the plurality of sensors configured to provide a bleedout condition signal;

providing a mold cavity plug corresponding in size to the plurality of mold cavity inlets such that when inserted at or near the mold cavity inlet, the mold cavity plug stops the flow of molten metal through the mold cavity; providing a robotic arm controlled by a robotic arm controller, the robotic arm being disposed to retrieve the mold cavity plug and to insert the mold cavity plug at or near any one of the plurality of mold cavity inlets to stop the flow of molten metal through that mold cavity;

providing the robotic arm controller being movable in three dimensions from a single location, and configured to utilize the bleedout condition signal and a predetermined x-y coordinate for the mold cavity at which the molten metal bleedout condition occurred, and further to control the robotic arm to place the mold cavity plug at or near the mold cavity inlet to stop the flow of molten metal through the mold cavity at which the molten metal bleedout condition occurred;

commencing of casting of molten metal through the mold table;

sensing a molten metal bleedout condition from one of the plurality of mold cavities;

providing the x-y coordinate for the molten metal bleedout condition from the one of the plurality of mold cavities to the robotic arm controller;

controlling the robotic arm to retrieve one of the plurality of mold cavity plugs; and controlling the robotic arm to insert the one of the plurality of mold cavity plugs at or near the mold cavity inlet where the molten metal bleedout condition was sensed, thereby stopping the flow of molten metal through the mold cavity.

7. A method for stopping the flow of molten metal through mold cavities on a molten metal mold table as recited in claim 6, and further comprising:

providing the robotic arm controller configured to utilize a gas nozzle to apply gas to the plurality of starting heads; and prior to commencement of casting, controlling the robotic arm to apply a flow of gas to the plurality of starting heads.

* * * * *